US005442432A

United States Patent [19]

Tani

[11] Patent Number: 5,442,432

[45] Date of Patent: Aug. 15, 1995

[54] RECORDING APPARATUS WITH A FINISHER HAVING MULTIPLE BIND MODES

[75] Inventor: Tatsuo Tani, Urayasu, Japan

[73] Assignee: Ricoh Company, Ltd., Tokyo, Japan

[21] Appl. No.: 289,270

[22] Filed: Aug. 11, 1994

Related U.S. Application Data

[62] Division of Ser. No. 84,146, Jul. 1, 1993.

[30] Foreign Application Priority Data

Jul. 1, 1992 [JP] Japan ..... 4-174406

[51] Int. Cl.[6] ..... G03G 21/00

[52] U.S. Cl. ..... 355/324

[58] Field of Search ..... 355/25, 308, 309, 321-324; 270/53

[56] References Cited

U.S. PATENT DOCUMENTS 4,640,611 2/1987 Ohdake et al. ..... 355/324 X 4,815,378 3/1989 Steinstra ..... 355/324 X 5,285,249 2/1994 Mahoney ..... 355/324

*Primary Examiner*—William J. Royer

*Attorney, Agent, or Firm*—Oblon, Spivak, McClelland, Maier & Neustadt

[57] ABSTRACT

A recording apparatus includes a first record mode for recording an image on one or both sides of a sheet and a second record mode for recording two pages of images on one side of a sheet and two pages of images on the other side of the sheet. The apparatus also includes a first bind mode for stacking the sheets which have undergone the first record mode on a staple tray and then binding the sheets by a stapler of a type which drives a staple into an edge of a stack of the sheets from above the stack, and a second bind mode for stacking the sheets which have undergone the second record mode and then binding the sheets at a center of the sheets. The recording apparatus provides for a particular order of pages and reduces cost and space by utilizing a stapler of the type which drives a staple from above a paper stack and a staple tray for both of an edge bind mode and a center bind mode.

2 Claims, 21 Drawing Sheets

RECORDING APPARATUS WITH A FINISHER HAVING MULTIPLE BIND MODES

This is a division of application Ser. No. 08/084,146, filed on Jul. 1, 1993.

BACKGROUND OF THE INVENTION

The present invention relates to a copier, facsimile apparatus, printer or similar recording apparatus and, more particularly, to a recording apparatus having a finisher capable of binding a stack of sheets at the center of the stack.

Sheets, e.g., paper sheets undergone recording at a recording apparatus are usually punched, stapled, provided with a cover, pasted, marbled, folded, stamped or otherwise finished. Traditionally, such a finishing procedure has been implemented by hand or an on-line automatic machine. Today, a finisher is available which is directly connectable to a recording apparatus to finish a paper stack efficiently.

A stapler, which is a specific form of the finisher, is capable of binding a paper stack at one or more points adjacent to an edge of the stack, binding it at the center, or binding it at the center and folding it at the center like a magazine. Binding and folding a sheet stack at the center is often used since it can readily bind a relatively small number of papers and, in addition, provides the bound papers with an attractive appearance as a book. However, a finisher with such a center binding and center folding capability has rarely been directly connected to a recording apparatus for the following reasons. To begin with, the order of pages carrying images thereon is complicated. Regarding the number of kinds, the center binding and center folding procedure is not sufficient alone. It is likely that the stapler is greater in size than the recording apparatus, obstructing the free use of space pages. Should the stapler be miniaturized, the position for the operator to take out a bound stack would be too low to promote easy operation.

Digital recording, which is a recent achievement in the imaging art, allows image data to be written to and read out of a multipage memory, promoting easy control of pages. Japanese Patent Laid-Open Publication No. 262772/1985, for example, discloses a finisher which folds a paper undergone recording, unfolds it, sequentially stacks such papers in the form of a saddle, and then binds them at the center. Japanese Patent Laid-Open Publication No. 52154/1988 teaches a finisher capable of displaying the order of documents to be copied and how to set a document on a glass platen in a center bind and fold mode. Japanese Patent Laid-Open Publication No. 12513/1987 proposes a finisher of the type determining whether or not to fold a paper stack depending on the paper size. Japanese Patent Laid-Open Publication No. 117174/1989 teaches a finisher having a stop for folding which moves in matching relation to size data representative of an irregular paper size entered. Further, Japanese Patent Laid-Open Publication No. 32271/1989 discloses a finisher which binds a paper stack, measures the size of the papers to determine a folding position, and then automatically adjusts the position of a stop on the basis of the resulting data. Specifically, this finisher determines a folding length in terms of an interval between the time when the trailing edge of a paper stack moves away from a sensor on a first path and the time when the leading edge of the stack reaches a sensor on a second path.

A folder for folding a stack of recorded papers has been proposed and realized in various forms in the past. The prerequisite with a folder is that a folded stack be provided with accurate dimensions, i.e., it be folded at an accurate position. The folding position depends on the physical property of papers. For example, as a paper stack abuts against a stop, it is caused to bend at the intermediate portion thereof and then caught by a pair of fold rollers to be fully folded. The distance between the leading edge of the paper stack and the folding position depends on the elasticity of papers. During the interval between the time when the paper stack abuts against the stop and the time when it is further driven and caught by the fold rollers, the papers of the stack undergo some elastic deformation between the stop and the fold rollers. This deformation and the bending rate of the folded portion depend on the papers. As a result, the folding position differs from one kind of paper to another even when the stop is held in the same position. In light of this, it has been customary for a skilled operator to finely adjust, for example, the position of the stop by repeating tentative folding. This, however, wastes time, labor, and cost. Furthermore, it is difficult to combine the center folding and binding function with the edge binding function. In addition, when a great number of papers should be folded, it is a common practice to sense the innermost paper at the trailing end and the outermost paper at the leading end. This makes the measurement inaccurate, e.g., the measured value depends on the number of papers.

A binder with a center binding and folding capability has a binding function. Hence, it is preferable to use such a binder for edge binding also.

SUMMARY OF THE INVENTION

It is therefore a first object of the present invention to provide a recording apparatus having a finisher operable in an edge bind mode and a center bind and fold mode which are predominant over other modes.

A second object of the present invention is to provide a recording apparatus having a finisher which clamps a paper stack to be moved so as to prevent it from being disturbed during movement.

A third object of the present invention is to provide a recording apparatus having a compact and inexpensive finisher capable of discharging a paper stack without finishing, discharging it after or without edge binding or folding, or discharging it after or without center binding or folding.

A fourth object of the present invention is to provide a recording apparatus having a finisher which allows the operator to take out paper stacks in exactly the same manner with no regard to the finish mode and stacks folded papers stably overcoming their stresses.

A fifth object of the present invention is to provide a recording apparatus having a finisher which requires a minimum of cost and space and stacks each of folded papers and non-folded papers in an optimal manner.

A sixth object of the present invention is to provide a recording apparatus having a compact and inexpensive finisher operable in both of an edge bind mode and a center bind mode.

A seventh object of the present invention is to provide a recording apparatus having a finisher which desirably folds a paper stack on a folding tray.

An eight object of the present invention is to provide a recording apparatus having a finisher capable of selectively binding a paper stack in an edge bind mode or in a center bind and fold mode with no regard to the paper size.

A ninth object of the present invention is to provide a recording apparatus having a finisher which reduces the amount of bending of a paper stack in the event of folding to insure stable discharge thereof.

A tenth object of the present invention is to provide a recording apparatus having a finisher which insures accurate folding with no regard to the number of papers or the paper size.

An eleventh object of the present invention is to provide a recording apparatus having a finisher which accurately matches a binding position and a folding position to each other.

A twelfth object of the present invention is to provide a recording apparatus having a finisher which accurately matches a binding position and a folding position on the basis of the conditions of paper sheets.

A thirteenth object of the present invention is to provide a recording apparatus having a finisher which reduces the cost and space and enhances rapid finishing by using a stapler of the type driving a staple from above a paper stack and a staple tray for both of an edge bind mode and a center bind mode.

A fourteenth object of the present invention is to provide a recording apparatus having a finisher which reduces the cost and space by using a stapler of the type driving a staple from below a paper stack and a staple tray for both of an edge bind mode and a center bind mode.

In accordance with the present invention, a recording apparatus comprises a staple tray held in an inclined position for stacking sheets undergone recording, a transporting device for sequentially transporting the sheets and releasing the sheets onto the staple tray such that the sheets advance upward, a reference member movable between a first or uppermost position adjacent to the lower end of the transporting device and a second position downwardly spaced apart from the first position along the surface of the staple tray, a stapler adjoining the first position of the reference member and comprising a hammering section located at one side of the surface of the staple tray for driving a staple into the sheets and a bending section located at the other side of the surface for bending the staple driven into the sheets, the hammering section and bending section being spaced apart from each other to allow the sheets to move therebetween, and control circuitry for selectively executing a first control mode for locating the reference member at the first position, stacking the sheets, and then stapling the sheets or a second control mode for locating the reference member at the first position, stacking the sheets, moving the reference member to the second position together with the sheets, and then stapling the sheets.

Also, in accordance with the present invention, a recording apparatus capable of binding sheets undergone recording selectively at an edge or at the center of the sheets by a stapler comprises a first transport path for transporting sheets sequentially coming out of the recording apparatus directly to a discharge section, a second transport path for transporting the sheets to a binding position where the stapler is to bind the sheets, a regulating device for binding the sheets at the edge or the center of the sheets by controlling the relative position of the stapler and sheets, a third transport path for transporting the sheets from the binding position to the discharge section, and a folder located on the third transport path for at least selectively folding the sheets in two, and a fourth transport path for transporting the sheets from the folder to the discharge section.

Also, in accordance with the present invention, a recording apparatus selectively operable at least in a first record mode for discharging sheets undergone recording at least after folding the sheets or a second record mode for discharging the sheets at least without finishing the sheets comprises a discharge tray for stacking sheets discharged in either of the first and second modes, a presser for pressing the sheets stacked on the discharge tray from above the sheets, and control circuitry for controlling the presser such that the presser exerts a pressure in the first mode or does not exert any pressure or exerts a low pressure in the second mode.

Also, in accordance with the present invention, a recording apparatus operable in a center bind mode for binding sheets undergone recording at the center of the sheets by a stapler comprises a substantially flat staple tray for stacking sheets thereon and capable of changing a relative position of the stapler and sheets for the center bind mode, a first discharging device arranged along the staple tray for driving the sheets from the staple tray to a discharge section, a pair of fold rollers facing a discharge path defined by the first discharging device, a stop selectively movable into or out of the discharge path for folding the sheets in cooperation with the fold rollers, and a second discharging device for driving the sheets from the pair of fold rollers to the discharge section.

Also, in accordance with the present invention, a recording apparatus capable of binding sheets undergone recording by a stapler comprises a substantially flat staple tray for stacking sheets thereon and changing a relative position of the stapler and sheets in matching relation to binding, a first discharging device arranged along the staple tray for transporting the sheets from the staple tray to a discharge section, a pair of fold rollers facing a discharge path defined by the first discharging means, a stop selectively movable into or out of the discharge path for folding the sheets in cooperation with the fold rollers, and a second discharging device for driving the sheets from the pair of fold rollers to the discharge section. The stop is movable to any one of a plurality of positions along the discharge path.

Also, in accordance with the present invention, a recording apparatus operable in a center bind mode for binding sheets undergone recording at the center of the sheets by a stapler comprises a substantially flat staple tray for stacking sheets thereon and capable of changing the relative position of the stapler and sheets for the center bind mode, a first discharging device arranged along the staple tray for driving the sheets from the staple tray to a discharge section, a pair of fold rollers facing a discharge path defined by the first discharging device, a stop selectively movable into or out of the discharge path for folding the sheets in cooperation with the fold rollers, and a second discharging device for driving the sheets from the pair of fold rollers to the discharge section. The first discharging device comprises a belt extending along the staple tray, a press roller for selectively pressing the belt against one of the pair of fold rollers from behind the belt, and a guide plate facing the belt and movable between a first position where a distance between the guide plate and the belt is comparatively great and a second position where the distance is comparatively small.

Also, in accordance with the present invention, a recording apparatus comprises a tray for stacking sheets undergone recording, a transporting device for transporting the sheets stacked on the tray, a stop for stopping the sheets being moved, a folder for folding the sheets in cooperation with the stop, a stop driver for selectively moving the stop forward or rearward in a direction of movement of the sheets, a signal generating device for generating a signal relating to at least either of the number and the physical property of the sheets, and a control circuitry for controlling the stop driver in response to the signal from the signal generating device.

Also, in accordance with the present invention, a recording apparatus comprises a tray for stacking sheets undergone recording, a stapler for binding the sheets stacked on the tray, a reference member for causing the sheets to be bound at the center thereof by setting up a particular relation between the stapler and the sheets, a first driver for moving the reference member along the surface of the tray, a transporting device for transporting the sheets bound by the stapler, a stop for obstructing the sheets being transported, a folder for at least folding the sheets in two in cooperation with the stop, a second driver for selectively moving the stop forward or rearward in a direction of movement of the sheets, a command generating device for generating a signal for commanding either of the first and second drivers to operate, and control circuitry for controlling the other of the first and second drivers in association with the signal.

Also, in accordance with the present invention, a recording apparatus comprises a tray for stacking sheets undergone recording, a stapler for binding the sheets stacked on the tray, a reference member for causing the sheets to be bound at the center thereof by setting up a particular relation between the stapler and the sheets, a first driver for moving the reference member along the surface of the tray, a transporting device for transporting the sheets bound by the stapler, a stop for obstructing the sheets being transported, a folder for at least folding the sheets in two in cooperation with the stop, a second driver for selectively moving the stop forward or rearward in a direction of movement of the sheets, a command generating device for generating a signal for commanding either of the first and second drivers to operate, and control circuitry responsive to the signal for controlling the other of the first and second drivers, wherein a control value for the first driver or a control value for the second driver is changed on the basis of the signal.

Also, in accordance with the present invention, in a recording apparatus, a first record mode for recording an image on one or both sides of a sheet, a second record mode for recording two pages of images on one side of a sheet and two pages of images on the other side of the sheet, a first bind mode for stacking the sheets undergone the first record mode on a staple tray and then binding the sheets by a stapler of the type driving a staple into an edge of a stack of the sheets from above the stack, and a second bind mode for stacking the sheets undergone the second record mode and then binding the sheets at the center of the sheets are provided. In the first record mode, recording begins with, among all the pages, the last page or the second page from the last, and the papers carrying all the pages are sequentially stacked on the staple tray such that the last page is lowest. In the second record mode and if a blank page exists, assuming that N papers are required to record the total number of pages including the blank page, recording begins with the "2N" page and "2N+1" page or with the "2N−1" page and "2N+2" page, and the sheets are sequentially stacked on the staple tray such that the "2N" page and "2N+1" page are lowest and then bound in either of the first and second bind modes.

In addition, in accordance with the present invention, in a recording apparatus, a first record mode for recording an image on one or both sides of a sheet, a second record mode for recording two pages of images on one side of a sheet and two pages of images on the other side of the sheet, a first bind mode for stacking the sheets undergone the first record mode on a staple tray and then binding the sheets by a stapler of the type driving a staple into an edge of a stack of the sheets from above the stack, and a second bind mode for stacking the sheets undergone the second record mode and then binding the sheets at the center of the sheets are provided. In the first record mode, recording begins with, among the total number of pages to record, the first page or the second page, and sheets carrying the total number of pages are sequentially stacked on the staple tray such that the first page is lowest. In the second record mode and if a blank page exists, assuming N sheets are required to record the total number of pages including said blank page, recording begins with the first page and "4N" page or with the second page and "4N−1" page, and sheets carrying the total number of pages are sequentially stacked on the staple tray such that the first page and "4N" page are lowest and then bound in either of the first and second bind modes.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 20A:
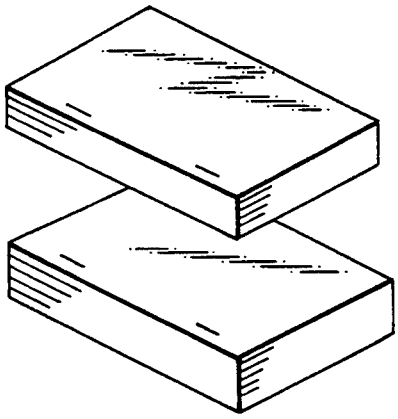
Fig. 20A PRIOR ART
FIGS. 20A–20C are views showing conventional paper binding nodes.
Figure 20B:
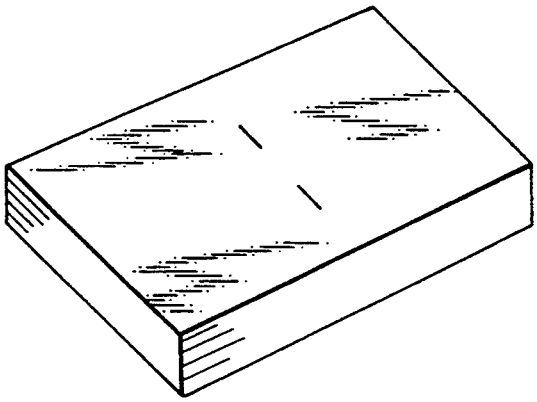
Fig. 20B PRIOR ART
Figure 20C:
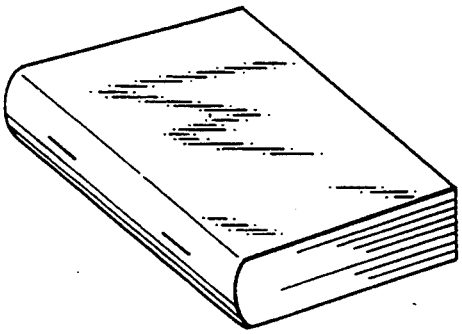
Fig. 20C PRIOR ART

Referring to FIGS. 20A–20C, some different ways of binding sheets, e.g., paper sheets available with a stapler or finisher are shown. Specifically, FIG. 20A shows papers bound at two positions at one edge thereof. FIG. 20B shows papers bound at two positions at the center thereof. The bound papers of FIG. 20B are folded at the center thereof in the form of a magazine, as shown in FIG. 20C.

Preferred embodiments of the recording apparatus in accordance with the present invention will be described which can implement the center bind and fold mode shown in FIGS. 20B and 20C.

FIGS. 1–6 show a copier representative of a first embodiment of the present invention. As shown, the copier has a photoconductive drum 8, a main charger 9, a transport belt 11, a cleaning unit 12, a fixing unit 13, trays 16A–16D, an intermediate tray 18 for a two-sided copy mode, and a scanner. The reference numeral 30 designates an optional paper feed unit having trays 31–34.

Documents D are stacked on a recycling automatic document feeder (RADF) 20 and fed to a glass platen one by one, the lowermost document being first. Each document D is laid on the glass platen, read by the scanner, and then returned to the top of the stack D. The images of the documents sequentially read by the scanner are stored in a memory and written on a photoconductive element by writing optics in a desired order. The writing optics includes a laser diode, polygonal mirror, and f-theta lens. A toner image produced by charging, exposure (writing) and development is transferred to a paper P fed from any one of the trays 16A–16D and 31–34. In a two-sided copy mode, the paper P carrying the toner image on one side thereof is steered by a path selector implemented as a pawl A toward the intermediate tray 18. Such papers P are sequentially stacked on the intermediate tray 18 and then refed from the tray 18 to form images on the other side thereof. The resulting two-sided copies are driven out of the copier by way of the fixing unit 13.

A finisher in the form of a binder 4 is operatively connected to the body of the copier. The binder 4 has a path selector or pawl C therein. When the papers P sequentially coming out of the copier do not have to be bound, the path selector C steers them upward toward a tray 41.

Figure 1:
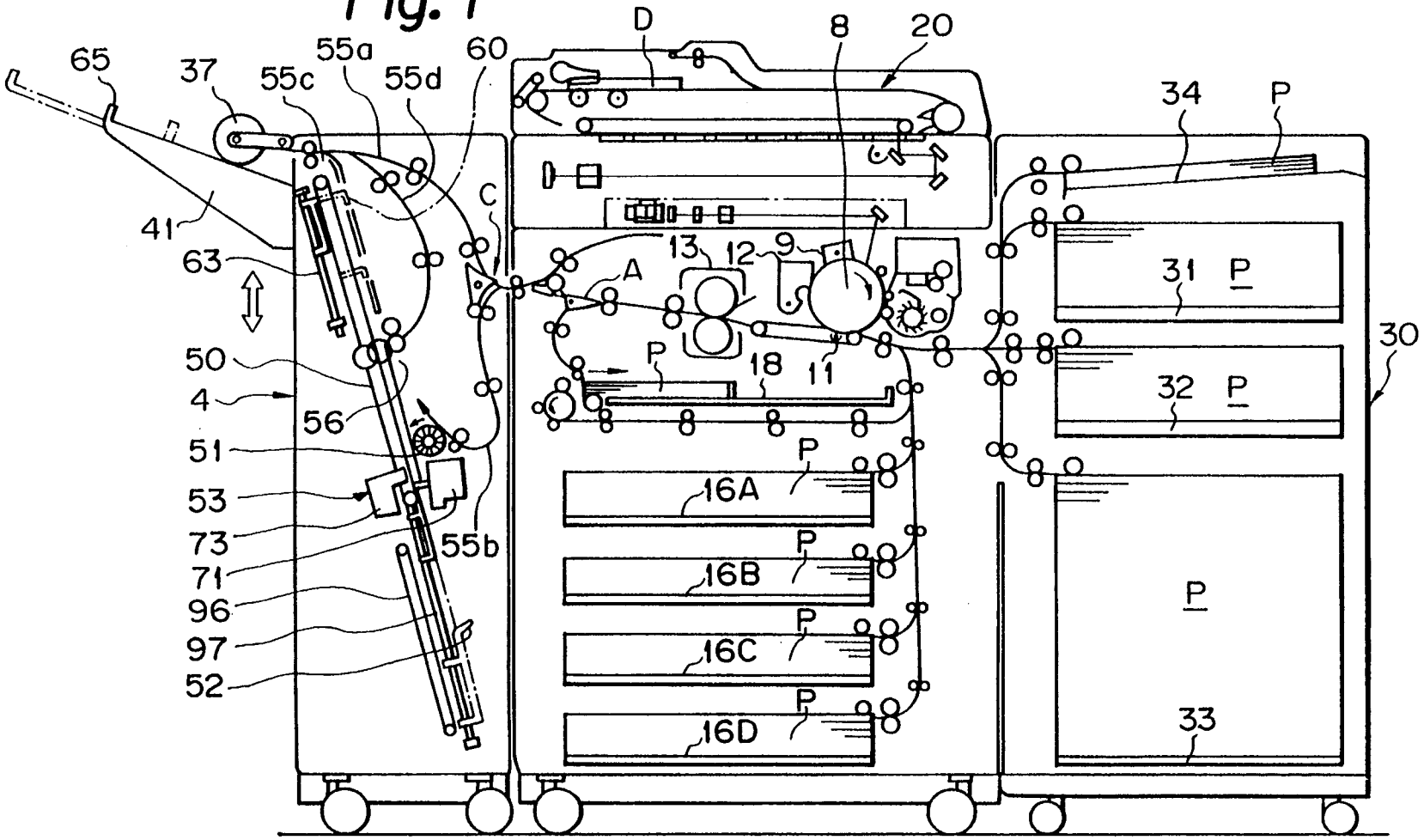
FIG. 1 is a section showing a first embodiment of a recording apparatus in accordance with the present invention.

A staple tray 50 is located in the binder 4 and inclined such that the left side is higher than the right side as viewed in FIG. 1. When the papers P from the copier are guided downward by the path selector C, they are stacked on the staple tray 50. At this instant, a brush roller 51 facilitates the downward movement of each paper P due to gravity, although this roller is not essential. The paper P is brought to a halt on abutting against a reference member 52. A jogger, not shown, positions the papers P neatly in the widthwise direction. The reference member 52 is movable downward along the staple tray 50. Specifically, when the papers P should be bound at the center, the reference member 52 is moved to a position matching the size of the papers P.

A stapler 53 is made up of a section for holding staples 70 (see FIG. 2) and driving them into the papers P, and a section for bending the staples 70 driven into the papers P. These sections of the stapler 53 are substantially separate from each other, so that the stacking position of the sheets P may be changed. The papers P are stapled at an upper position in the event of edge binding or at the above-mentioned lower position in the event of center binding. The stapled papers P are transported upwardly along the staple tray 50 and then driven out to the tray 41.

Figure 2:
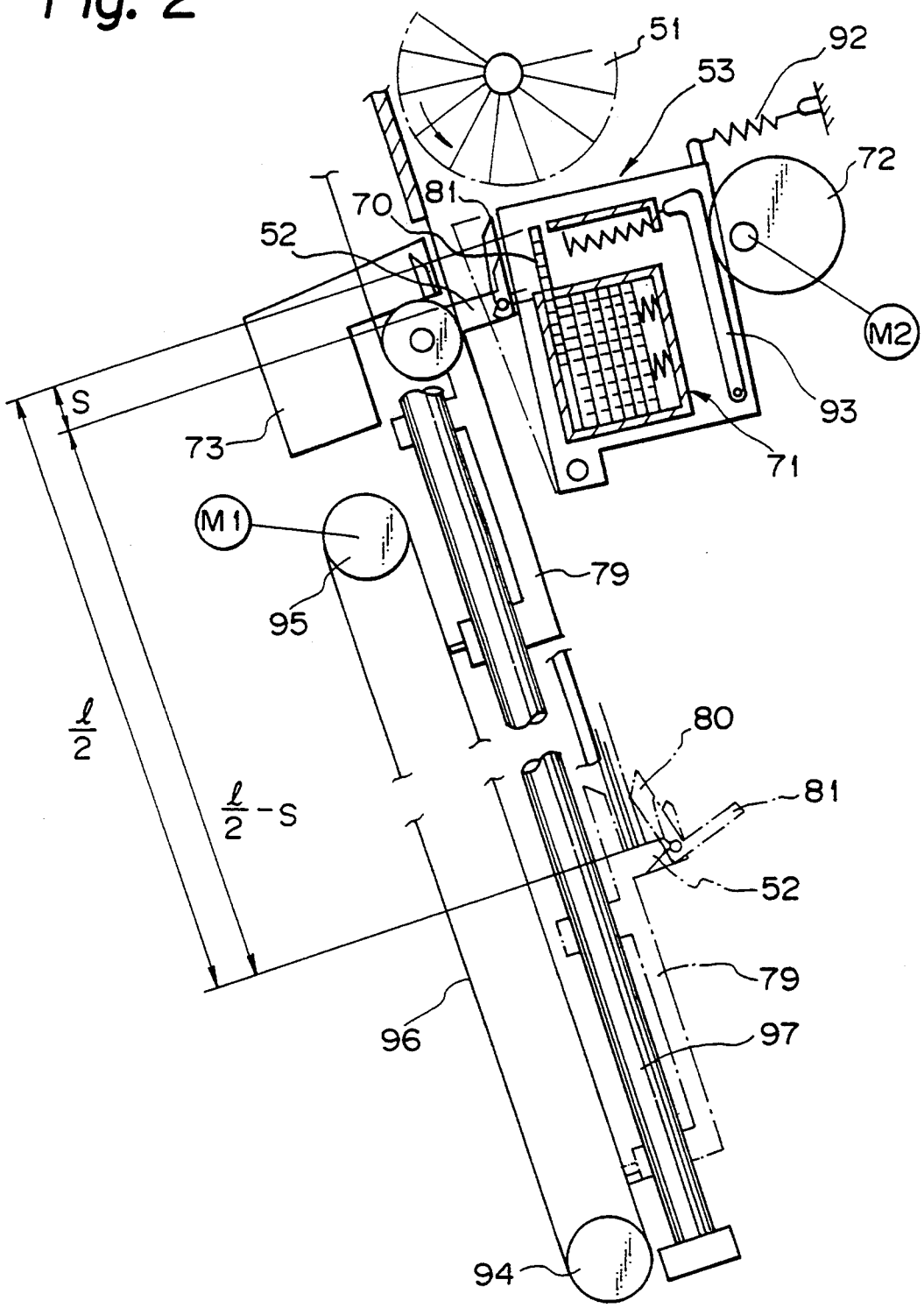
FIG. 2 shows a staple tray included in the first embodiment.

FIG. 2 shows a specific arrangement for driving the reference member 52. As shown, a reversible motor M1 selectively raises or lowers the reference member 52 along the staple tray 50. Assume that the papers P have a length l in the direction of transport, and that the binding margin for edge binding is S. Then, the displacement of the reference member 52 from the edge binding position to the center binding position is L/2-S.

The stapler 53 is loaded with a staple cartridge 71 having a number of straight staples 70 which are weakly bonded together and stacked in a sheet configuration. As a staple 70 is ejected from the cartridge 71, it is bent by the rotation of a press cam 72 and then driven into the papers P. The cartridge 71 may be of the type accomodating bent staples, if desired. A bending member 73 is located to face the cartridge 71 for bending the ends of the staple 70. The bending member 73 may be of the type having a U-shaped recess which guides the ends of the staple 70 and bends them due to the above-mentioned hammering force. Alternatively, this member 73 may be of the type bending the staple 70 by use of exclusive power after the staple 70 has been driven into the papers P. When the stapler 53 is so constructed as to be movable perpendicularly to the direction of movement of the papers P, it can bind the papers P at two spaced edge positions or at adjusted positions. The reference member 52 is mounted on a slider 79. A presser member or pawl 80 presses the paper P abutted against the reference member 52. A release member 81 releases the presser member 80 from the paper P. A coil spring 92 constantly biases the stapler 53 toward the press cam 72. An arm or hammer 93 is caused to thrust one staple 70 out of the cartridge 71 by the press cam 72 when the cam 72 is rotated. A belt 96 is passed over pulleys 94 and 95. The slider 79 is affixed to the belt 96 and guided by a guide shaft 97.

When the reference member 52 is driven to move the papers P, it is likely that the force acting on the papers P (gravity and the propelling force of the brush roller 51) is short and causes the neat stack to be disturbed. In light of this, the presser member 80 is provided on the reference member 52 so as to press the papers P while the papers P are in movement. The presser member 80 is constantly biased toward the papers P by a spring. In the stacking position, a stationary member, not shown, presses the release arm 81 to allow the papers P to be stacked. As soon as the reference member 52 starts moving, the force acting on the release arm 81 is cancelled with the result that the presser member 80 again presses the papers P. For this purpose, a solenoid, motor or any other suitable drive source may be used.

An arrangement may be made such that the papers P are stacked one by one after the reference member 52 has been shifted to a position matching edge binding or center binding. However, when the reference member 52 is lowered in a center bind mode, the following paper P is apt to abut against the preceding paper P abutting against the reference member 52, depending on the paper size. To eliminate this problem, a plurality of paper inlet portions each matching a particular paper size may be provided.

In the illustrative embodiment, the reference stacking position and stapling position for edge binding are substantially fixed relative to the paper inlet portion. In the event of center binding, the papers P once stacked in the edge binding position are bodily moved to the center binding position. Hence, the papers can be stacked stably at low cost in both of the edge bind mode and center bind mode.

Figure 3:
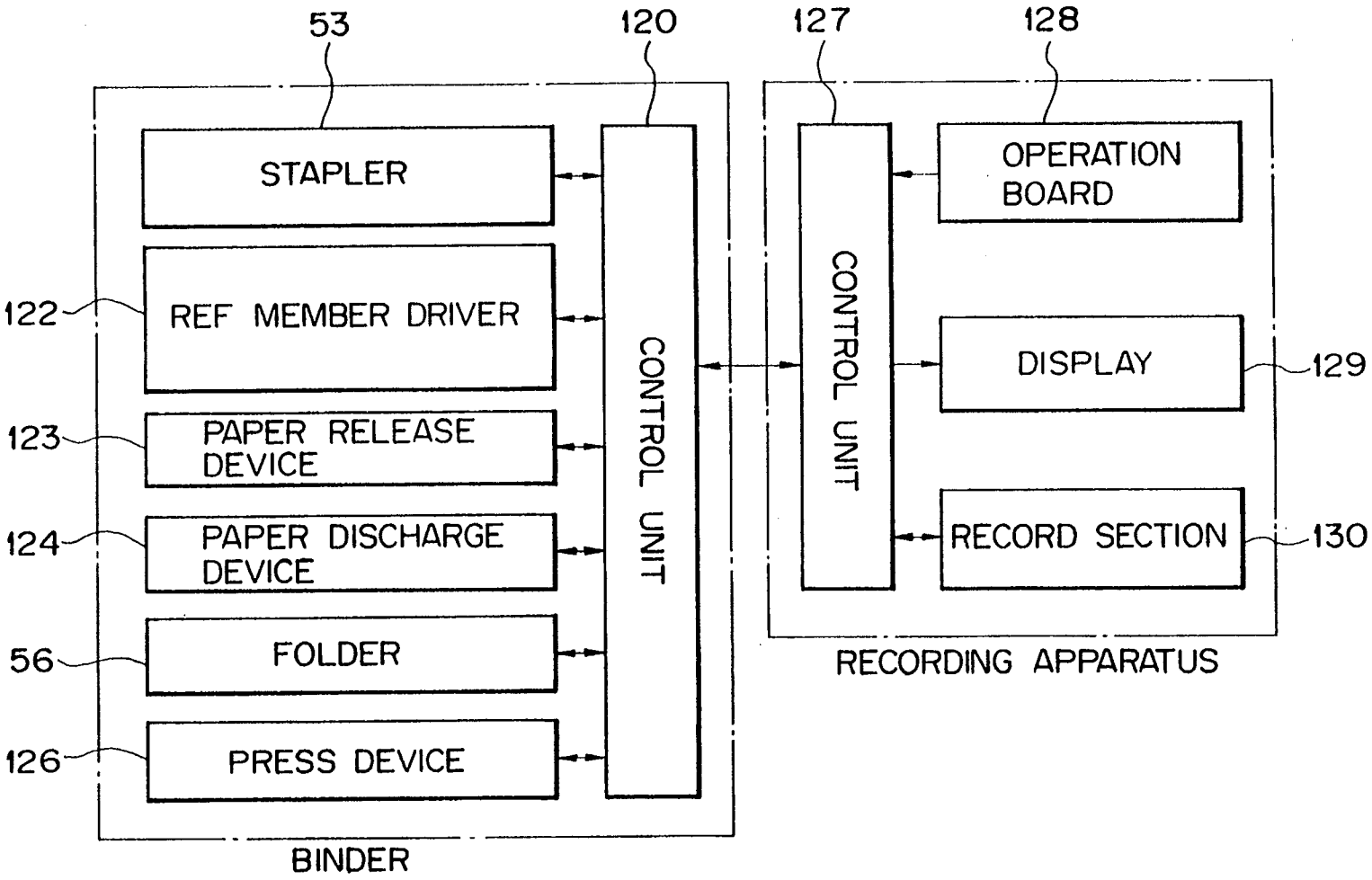
FIG. 3 is a schematic block diagram of control circuitry also included in the first embodiment.

Referring to FIG. 3, control circuitry particular to the embodiment is shown in a schematic block diagram. There are shown in the figure a control unit 120 included in the binder 4, the stapler 53, a reference member driver 122, a paper releasing device 123, a paper discharging device 124, a folder 56, a pressing device 126, a control unit 127 included in the copier, an operation board 128, a display 129, and a printing section 130. The control unit 120 controls the stapler 53, reference member driver 122, paper releasing device 123, discharging device 124, folder 56, and pressing device 126. The control unit 127 controls the operation board 128, display 129, and printing section 130. The two control units 120 and 127 are connected to each other.

Figure 4:
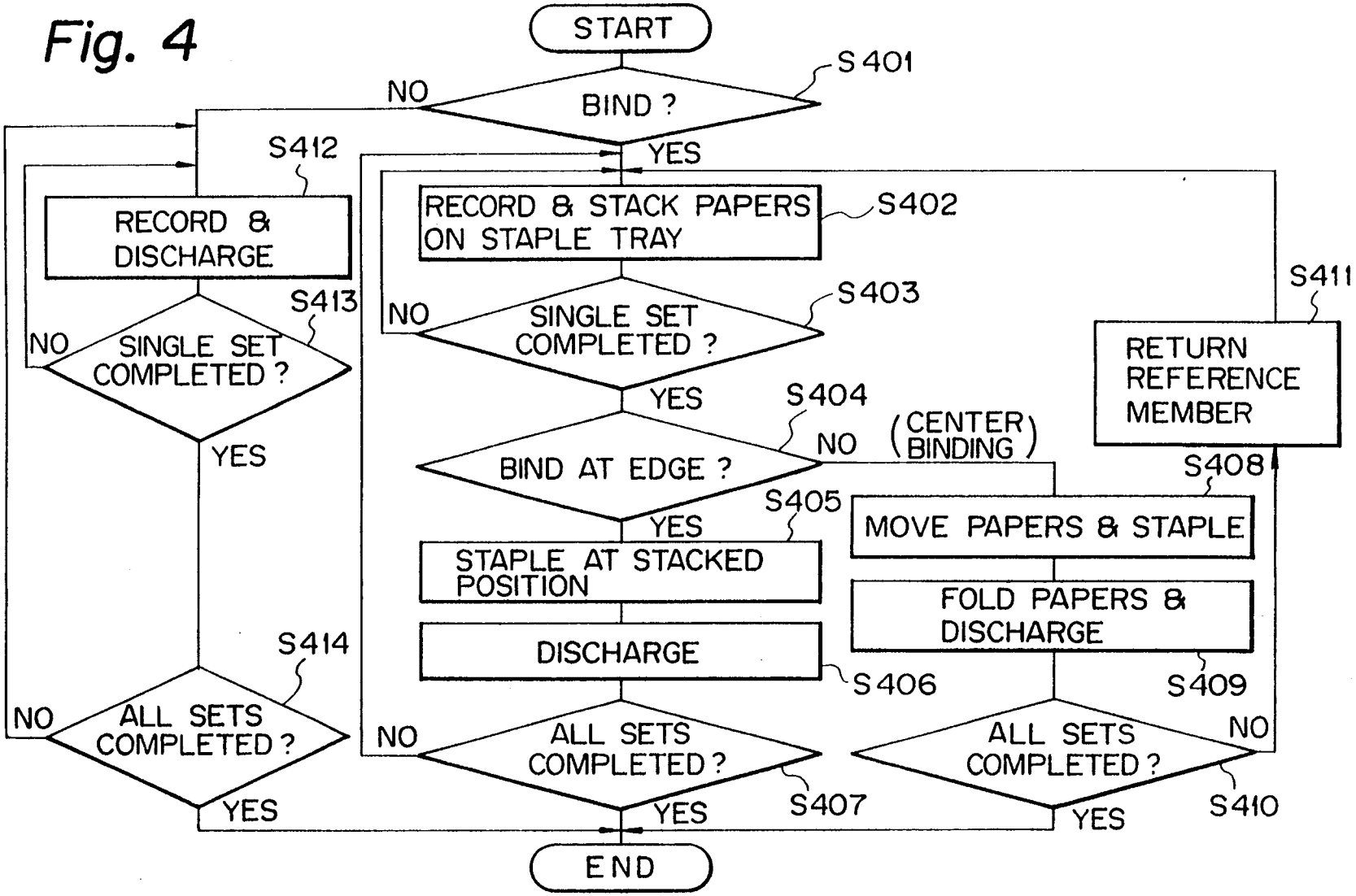
FIGS. 4 and 5 are flowcharts representative of a specific operation of the control circuitry shown in FIG. 3.

A specific operation of the embodiment will be described with reference to FIG. 4. As shown, when the papers P should be bound (YES, step S401), they are sequentially stacked on the staple tray 50 by way of the path selector C (step S402). When a single set of papers or copies P are completed (YES, step S403) and in an edge bind mode (YES, step S404), the papers P are directly stapled and then driven out (steps S405 and S406). Such a procedure is repeated until all the desired sets of papers P have been bound (YES, step S407). In a center bind mode (NO, step S404), the papers P are shifted and stapled (step S408), and then folded and driven out (step S409). If all the desired sets of papers P have not been bound (NO, step S410), the reference member 52 is returned, i.e., raised (step S411). This is followed by the steps S402–S404. When the papers P do not have to be bound (NO, step S401), they are steered upwardly by the path selector C until all the desired sets have been completed (steps S412, S413 and S414).

Figure 6:
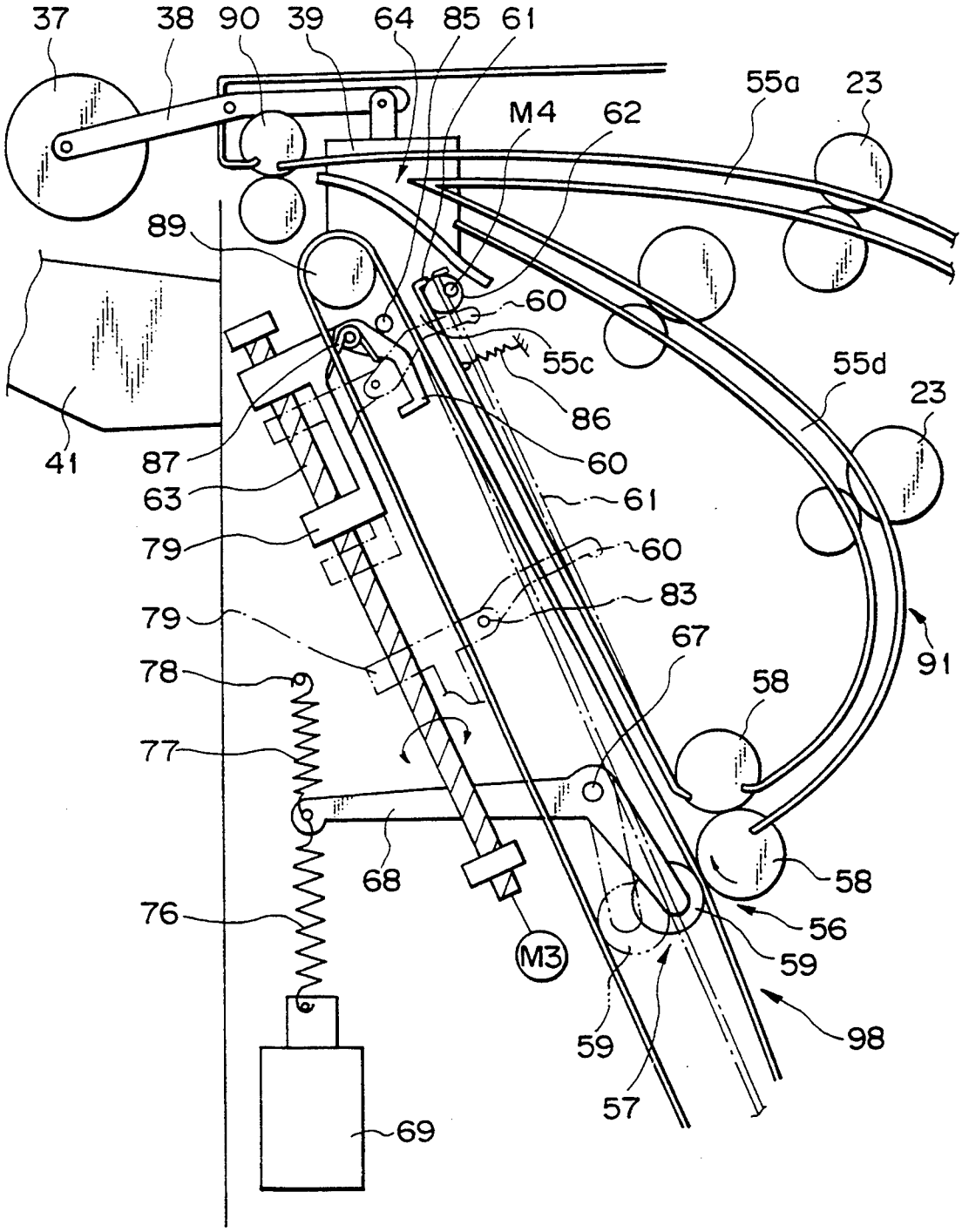
FIG. 6 is a fragmentary section of the staple tray.
Figure 7:
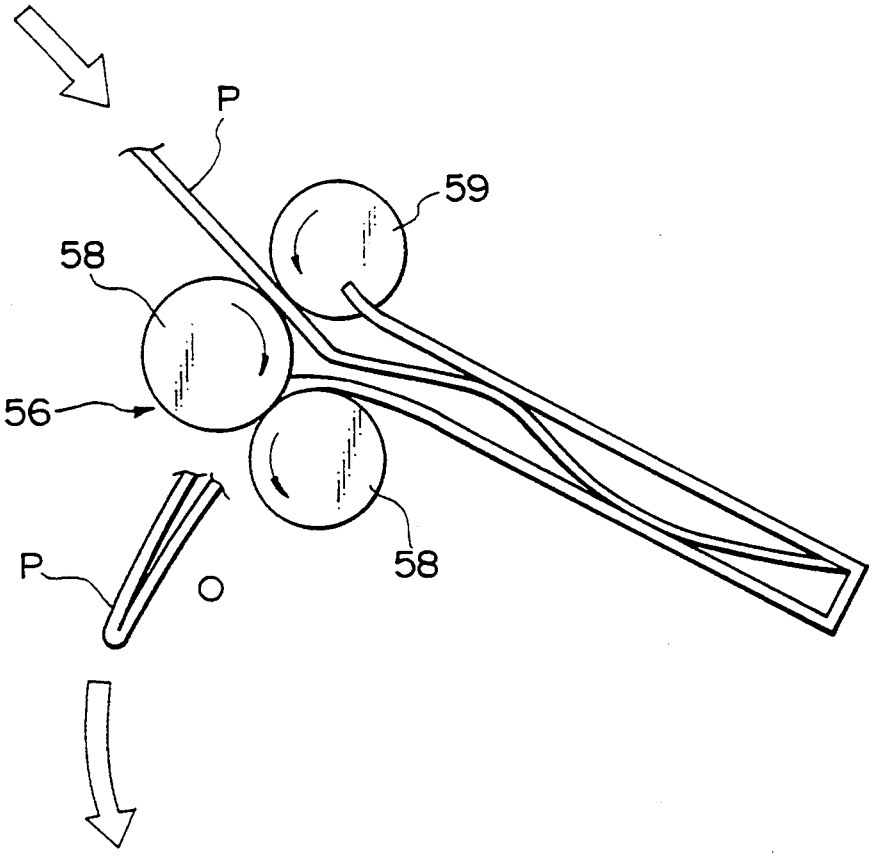
FIG. 7 shows a folder representative of a second embodiment of the present invention.

It is preferable that the papers P bound at the center be automatically folded in two at the center. In the illustrative embodiment, as shown in FIG. 6, the folder 56 is provided on the path extending from the staple tray 50 to the tray 41 to be selectively operable. The folder 56 implements an inexpensive and miniature binder capable of folding papers without binding them, folding papers after binding them at the center, folding papers after binding them at the edge, binding papers at the center but not folding them, or binding papers at the edge but not folding them, as desired. This can be done when the binder 4 is provided with various paper paths shown in FIG. 1, i.e., a first path 55*a* for discharging the papers P without binding or folding, a second path 55*b* for transporting the papers P to the staple tray 50, a third path 55*c* for discharging the papers P from the staple tray 50, and a fourth path 55*d* extending from the folder 56 provided on the third path 55*c* to the tray 41. When the papers P are stacked on the staple tray 50 and then passed through the fourth path 55*d* without being bound, they will be simply folded.

As shown in FIG. 6, the first, third and fourth paths (all the discharge paths) 55*a*, 55*c* and 55*d* merge into a common path 64 which terminates at the tray 41. Hence, a single tray 41 can receive papers P undergone any one of the finish modes, also implementing an inexpensive binder. In addition, the finished papers P can be taken out by hand in the same manner with no regard to the finish mode. The problem with the folded papers P is that they are apt to open on the tray 41 due to the stresses remaining therein and interfere with the following papers P. In the light of this, a presser member 37 may be used to press the folded papers P stacked on the tray 41. This, however, brings about another problem that when the papers are discharged one by one without finishing, the load of the presser member 37 is excessive and apt to bend or otherwise deform them, resulting in defective stacking. To stack the papers P in an optimal manner with no regard to the paper handling mode, the embodiment causes the presser member 37 to press at least the folded papers P and not to press or to lightly press the papers P undergone no finishing (see FIG. 5). The presser member 37 may be constituted by a roller or a trailing type blade. Further, the roller may be of the type driven by the paper P or of the type rotated at a predetermined speed. A movable stop 65, FIG. 1, may be provided on the tray 41. The stop 65 is moved to a position matching the paper size either by hand or by a drive mechanism, not shown.

A tray, not shown, exclusively assigned at least to the papers P not undergone finishing may be provided in addition to the tray 41 assigned at least to the folded papers P. Then, the presser member 37 will be associated with the tray 41. The extra tray makes it needless to switch the presser member 37 in matching relation to the mode.

To staple papers P and then fold them, it has been customary to transport the papers P from the staple tray 50 to a folding station, fold them there, and then drive them out. This, however, requires an exclusive space for folding in the direction of paper transport in addition to the staple tray 50, increasing the size and cost of the binder. In the illustrative embodiment, as shown in FIG. 6, a major part of the discharge path from the staple tray 50 (assigned to edge binding) is implemented by the staple tray 50 to reduce the size and cost of the binder.

Specifically, there are shown in FIG. 6 a transport roller 23, a belt 57, fold rollers 58, a press roller 59, a stop 60 for folding, a guide plate 61, a cam 62, a threaded shaft 63, a shaft 67, a lever 68, a solenoid 69, coil springs 76 and 77, an anchor 78, the slider 79, a shaft 83, a fixed pin 85, a coil spring 86, a torsion spring 87, a pulley 89, a discharge roller 90, a second discharging device 91, an arm 38, and a solenoid 39. As a motor M3 rotates the threaded shaft 63, the stop 60 is moved along the staple tray 50 (discharge path) to a position matching the paper size. Specifically, the stop 60 is movable over a distance between a position slightly outward of a position corresponding to the maximum paper size on the staple tray 50 and a position suitable for folding papers of small size. When the stop 60 is moved further outwardly, it is caused to fall down by the pin 85 and retract from the tray surface. In such a position, the stop 60 does not obstruct the straight discharge of non-folded papers P. Alternatively, the stop 60 may be retracted at a position close to the fold rollers 58 or may be retracted by any other suitable method.

The papers P stacked on the staple tray 50 begin to be driven along the first discharging device 98 toward the tray 41 by the belt 57 after or without stapling. When the papers P are of maximum size, they are brought to a stop as their leading edges abut against the stop 60. Then, the papers P begin to bend at their portion facing the fold rollers 58. As a result, the papers P are caught by the fold rollers 58 and driven toward the second discharging device 91. These papers P are moved along the fourth path 55*d* with the fold thereof at the head and then discharged to the tray 41. As far as stacking the papers P on the staple tray 50 is concerned, the stacking surface of the tray 50 should preferably be flat. However, when it comes to folding, the flat stacking surface would prevent the papers P from bending accurately in the desired direction on abutting against the stop 60. To stabilize the bending direction and insure a sufficient propelling force, the embodiment urges the press roller 59 against the fold rollers 58 via the belt 57 in the event of folding. Assume that the path between the stop 60 and the fold rollers 58 is free when the papers P abut against the stop 60. Then, the papers P would bend on such a path, resulting in an inaccurate fold. In light of this, the embodiment disposes the guide plate 61 covering at least the above-mentioned path over the staple tray 50. Furthermore, in the event of folding, the guide plate 61 should preferably be positioned closer to the staple tray 50 than in the event of stacking or straight discharge. For this reason, the cam 62 is rotated by a motor M4 to adjust the distance between the guide plate 61 and the staple tray 50. This distance may be corrected in matching relation to the characteristic and number of the papers P so as to bind and fold the papers P at the same position with higher accuracy. The papers P bound and folded may have their edges opposite to the bound portion cut, if desired.

Figure 5:
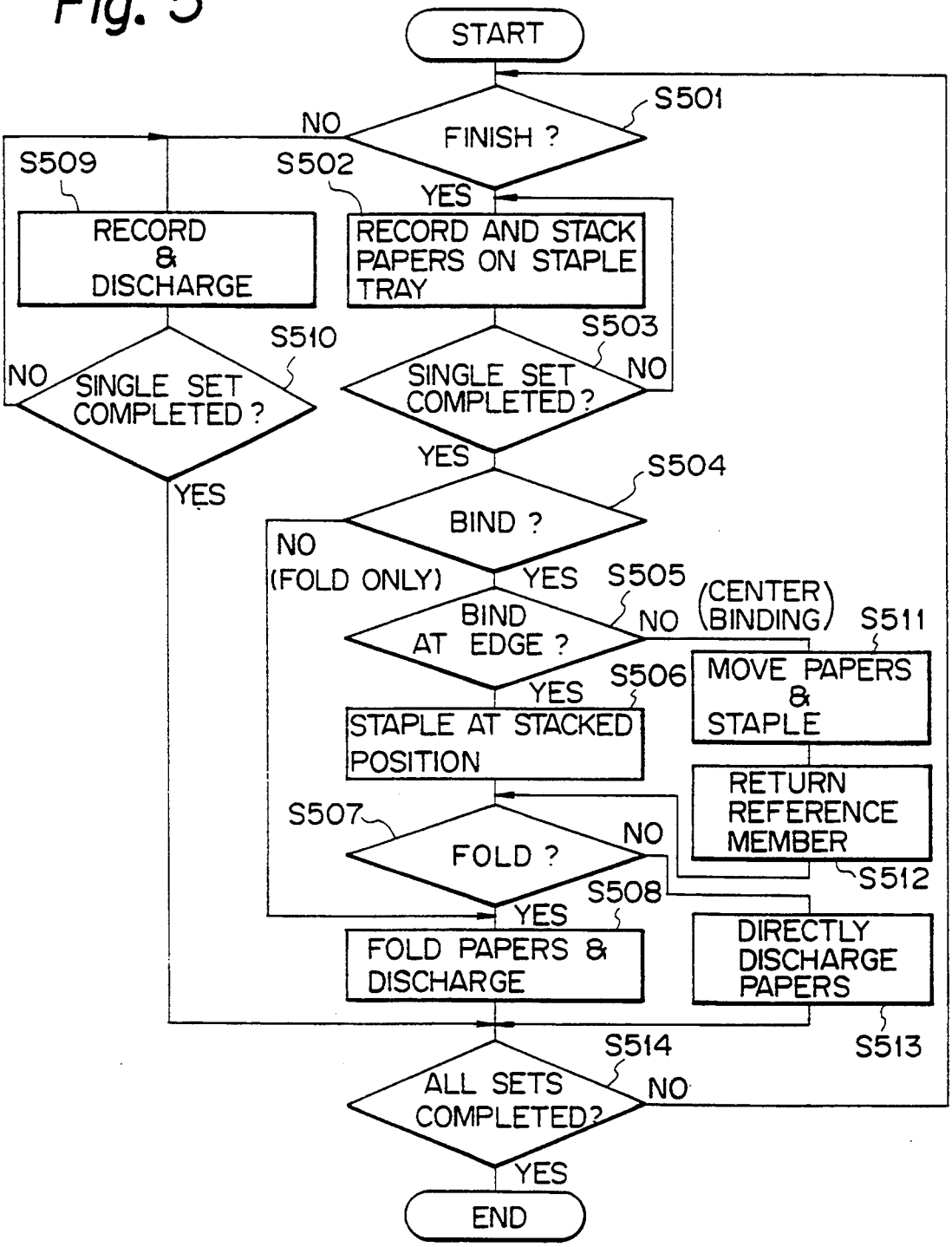

FIG. 5 shows a specific sequence for implementing the above-described modes. As shown, when the papers P should be finished (YES, step S501), they are stacked on the staple tray 50 (step S502). When a desired set of papers P are fully stacked on the staple tray 50 (YES, step S503) and in an edge bind mode (YES, step S504 and YES, step S505), the paper sheets P are stapled at the same position (step S506). In a center bind mode (YES, step S507), the papers P are folded and then discharged (step S508). In the event of folding which is not accompanied by binding (NO, step S504), the papers P are folded and then discharged (step S508). In the event of center binding (NO, step S505), the papers P are shifted and then stapled (step S511), and subsequently the reference member 52 is returned (step S512). This is followed by the step S507. When the papers P bound at the edge are not to be folded (NO, step S507), they are directly discharged (step S513). Further, when the papers P should not be finished (NO, step S501), they are simply discharged (YES, steps S509 and S510). The above procedure is repeated until all the desired sets of papers P have been dealt with (YES, step S514). Then, the program ends (YES, step S514).

The embodiment described above has various advantages, as follows. The reference member 52 is located below the position where the papers P are sequentially released into the inclined staple tray 50. The reference member 52 is moved by a motor to effect edge binding or center binding, as needed. This, coupled with the fact that the papers are discharged upwardly from the staple tray 50, realizes stable edge binding and center binding at low cost with a minimum of space. In addition, the papers P stacked on the tray 41 can be taken out with ease.

In the illustrative embodiment, the papers P and the stapler 53 are provided with a particular relation in relation to the reference member 52 in each of the edge bind mode and center bind mode. Specifically, as shown in FIG. 2, the reference member 52 selectively assumes a first position or substantially uppermost position or a second position which is spaced apart (I/2-s), where l is the length of a paper P, downward from the first position along the surface of the staple tray 50. The stapler is so positioned as to bind the papers P at a position spaced apart a distance s upwardly from the reference stacking surface of the first position. Hence, the various constituent parts of the stapler can be arranged efficiently in the limited space.

The papers P are stacked at the same position in both of the edge bind mode and center bind mode. In the center bind mode, the stacked papers P are bodily moved and then bound. Therefore, the papers P can be stacked and stapled stably in both of the two modes. When the stacked papers P are moved to be bound at the center thereof, the presser member or clamper associated with the reference member 52 clamps them to insure a neat stack.

The four transport paths 55*a*–55*d* implement five different discharge modes, i.e., a non-finish discharge mode, an edge bind mode with or without folding, and a center bind mode with or without folding at low cost and in a compact arrangement. Further, in all of such discharge modes, the papers P are driven out onto a single tray 41. This allows the operator to take out the papers P in the same manner with no regard to the discharge mode. The papers P at least undergone folding may be discharged to a tray independent of a tray assigned at least to the papers P which are not finished. In such a case, the presser member 37 will be associated with the tray assigned to the folded papers P to stack the papers P with accuracy. Furthermore, both of the two different kinds of papers P may be stacked on a single tray, in which case the presser member 37 will act at least on the folded papers P. Then, stacking conditions suitable for all of the discharge modes can be implemented by a single tray, and the papers P can be taken out in the same manner.

A major part of the staple tray 50 also plays the role of a discharge path. The folder 56 operates on the staple tray 50 during the course of paper discharge. Hence, a compact and inexpensive binder with an edge binding capability and a center binding capability is realized. The discharge tray is constituted by the belt 57 extending along the staple tray 50. In the event of folding, the press roller 59 presses the belt 57 against the fold rollers 58. The folder, therefore, can fold the papers P stably in a predetermined direction and in a predetermined dimension. In addition, the papers P are driven by a sufficient propelling force.

The stop 60 for folding the papers P is arranged at or movable to a plurality of positions. Hence, even the papers P of different sizes can be bound at the edge or the center, as desired. Further, since the stop 60 can retract from the surface of the staple tray 50, edge binding or center binding can be readily selected at low cost. Moreover, since the guide plate 61 intervening between the stop and 60 and the fold rollers 58 is movable, it does not interfere with the stacking or the discharge of edge-bound papers P. This allows the papers P to be accurately folded.

While the embodiment has concentrated on a digital copier, it is similarly applicable to an analog copier which optically projects a document image onto a photoconductive element, or even to a facsimile apparatus or a printer.

Referring to FIGS. 7–15B, a second embodiment of the present invention will be described.

Figure 8:
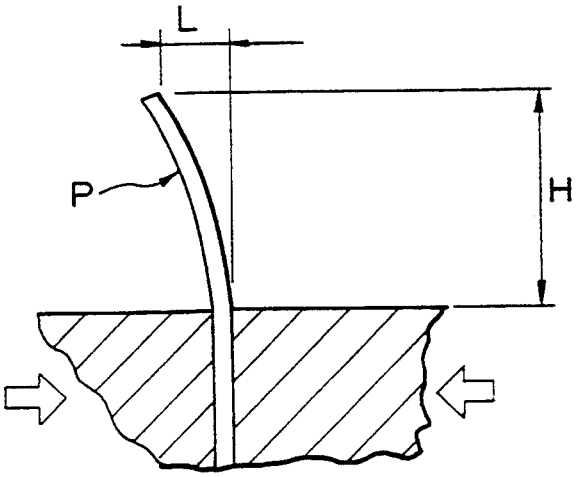
FIG. 8 is a view indicative of how the elasticity of a paper is determined and associated with the second embodiment.
Figure 9:
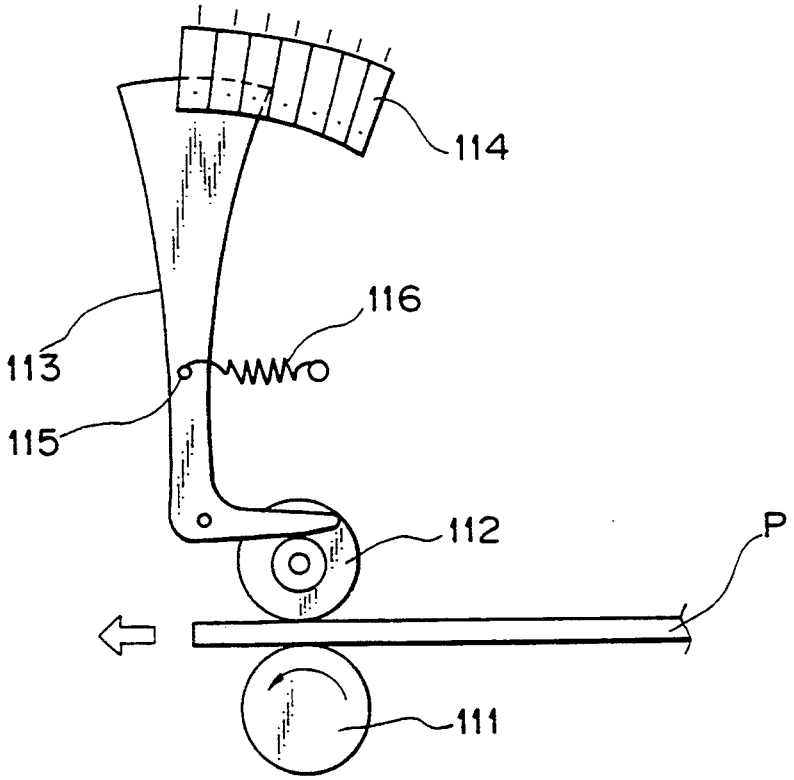
FIG. 9 shows another implementation for measurement particular to the second embodiment.

Generally, the physical properties of the papers P that effect the folding accuracy include their elasticity and their coefficient of friction with respect to the fold rollers 58. As shown in FIG. 8, to determine the elasticity, a paper P is held by a retaining member such that it protrudes a predetermined distance H above the retaining member. In this condition, the elasticity is determined in terms of an amount L in which the paper P bends. Further, the elasticity is influenced by the thickness of the paper P, density, direction of fibers, an additive, water content, humidity, temperature, etc. Regarding the elasticity, the measured value L or a rank associated therewith may be entered on the operation board 128 (see FIG. 12). Alternatively, as shown in FIG. 9, the thickness of the paper P which is most closely related to the elasticity may be measured during transport. The resulting signal representative of the thickness may be corrected on the basis of the ambient temperature and humidity. To further enhance the accuracy, the coefficient of friction of the paper P may be measured and entered on the operation board 128 or may be measured within the recording apparatus or the binder. The arrangement shown in FIG. 9 has a roller 111, a movable roller 112, a sensing lever 113, a sensing section 114, a shaft 115 on which the lever 113 is rotatable, and a tension spring 116 constantly biasing the lever 113.

Figure 12:
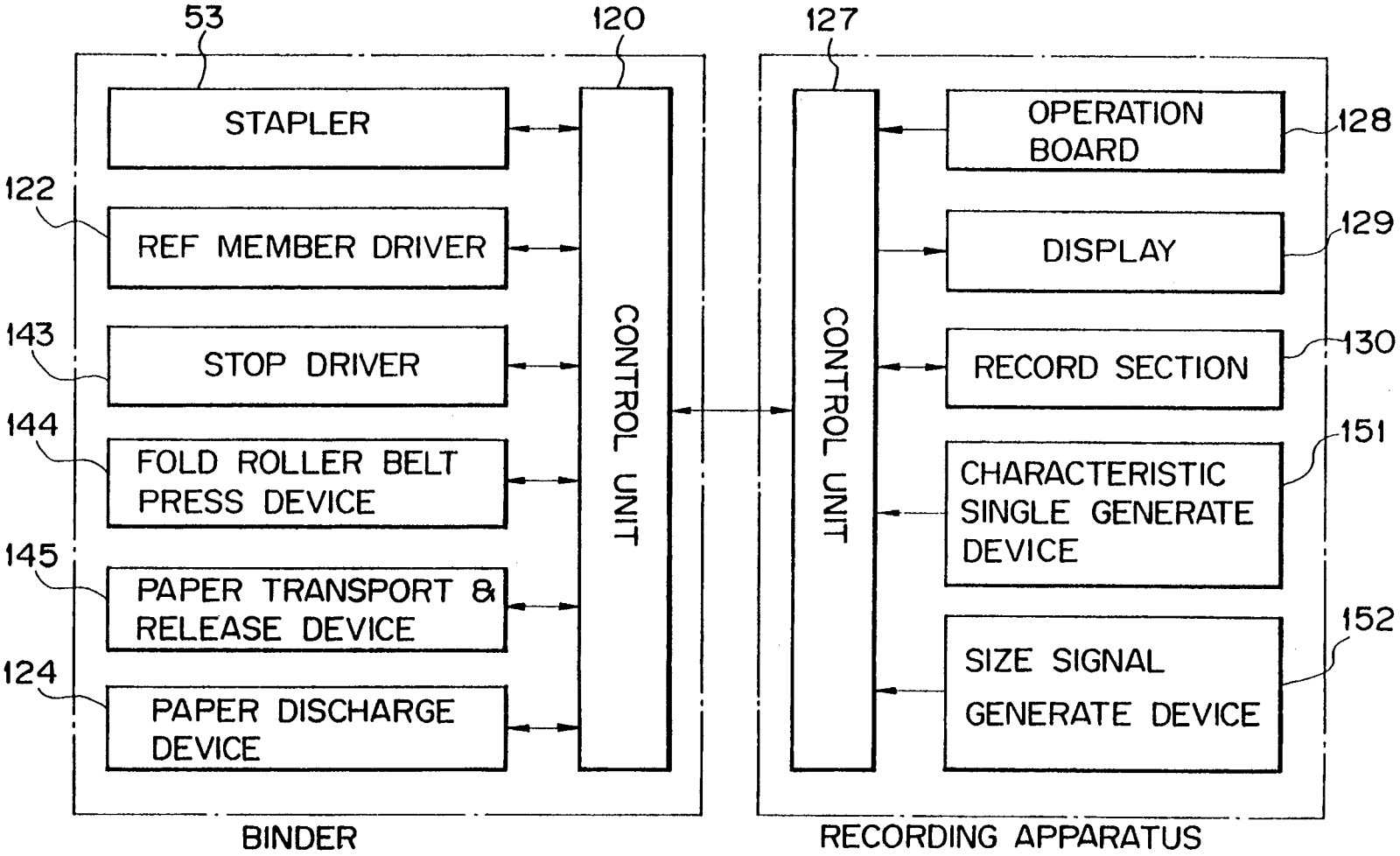
FIG. 12 is a schematic block diagram of control circuitry included in the second embodiment.
Figure 13:
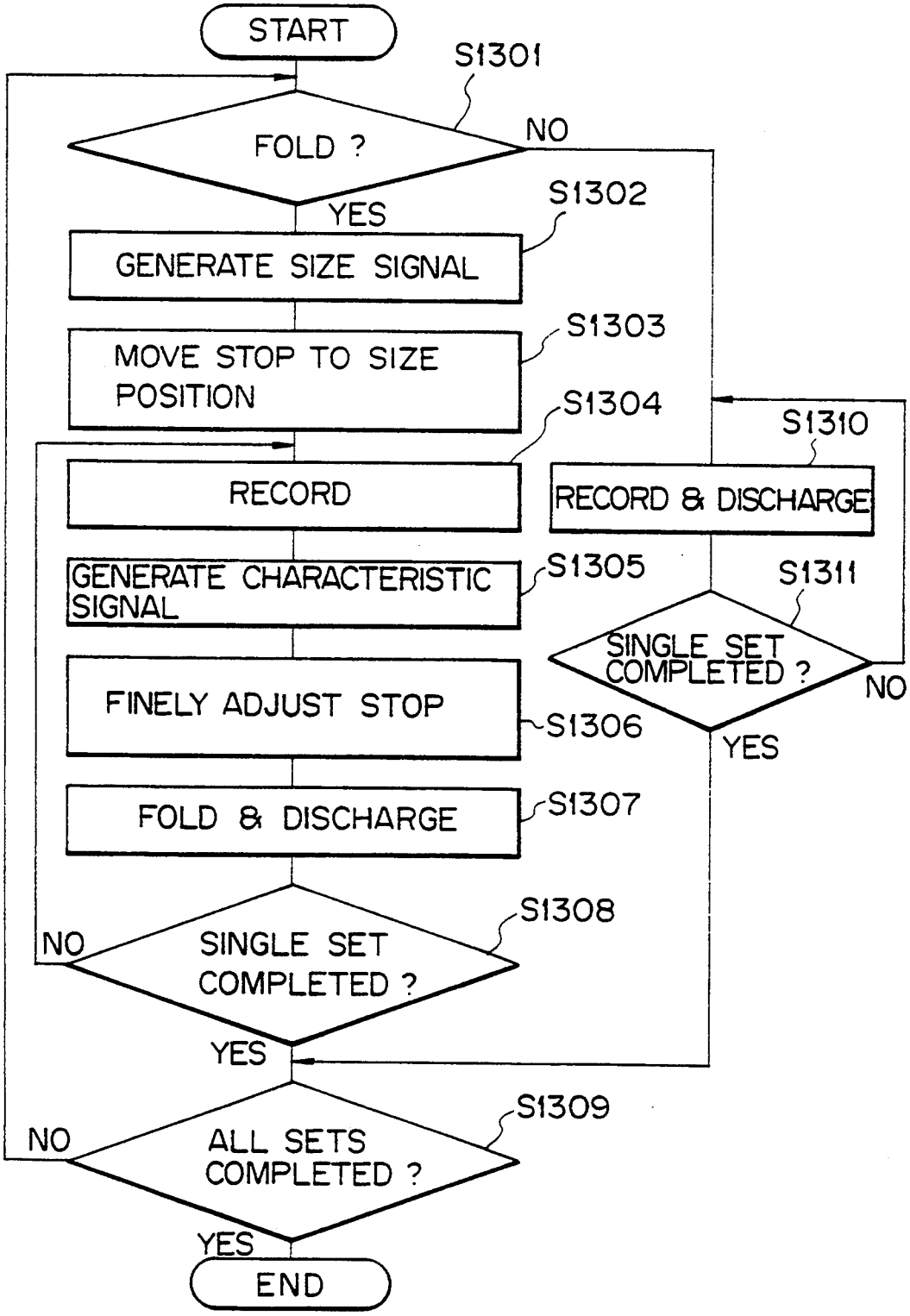
FIGS. 13, 14 and 15A and 15B are flowcharts each demonstrating a specific procedure to be executed by the control circuitry of FIG. 12.

FIG. 12 shows control circuitry for changing the folding condition, i.e., the position of the stop 60 in matching relation to the characteristics of the papers P. FIG. 13 demonstrates a specific procedure to be executed by the control circuitry. As shown in FIG. 12, the control circuitry has the control unit 120 incorporated in the binder, the stapler 53, the reference member driver 122, a stop driver 143, a fold roller and belt pressing device 144, a paper transport and releasing device 145, the paper discharging device 124, the control unit 127 included in the recording apparatus, the operation board 128, the display 129, the recording section 130, a characteristic signal generating unit 151, and a size signal generating unit 152. The control unit 120 controls the stapler 53, reference member driver 122, stop driver 143, fold roller and belt pressing device 144, paper transport and releasing device 145, and paper discharging device 124. The control unit 127 controls the operation board 128, display 129, recording section 130, characteristic signal generating unit 151, and size signal generating unit 152. The control units 120 and 127 are connected to each other.

Referring to FIG. 13, the procedure for changing the folding condition, i.e., the position of the stop 60 will be described. This procedure is assumed to fold the papers P one by one. As shown, the stop 60 is moved to a position matching the size of the paper P by a paper size signal (YES, step S1301 and steps S1302 and S1303). Alternatively, one of a plurality of stops 60 matching the paper size may be selected. A recording operation is performed before or after the movement of the stop 60 (step S1304). The position of the stop 60 is finely adjusted in response to a paper characteristic signal which will be received before or after the recording operation (steps S1305 and S1306). Then, the paper P is folded and discharged (step S1307). The shift of the stop 60 to the position matching the paper size and the fine adjustment may be implemented as a continuous sequence, if desired. The steps S1304–S1308 are repeated until a single set of papers have been dealt with. Further, the steps S1301–S1309 are repeated until all the desired number of sets of papers have been completed. On the other hand, when the papers P should not be folded (NO, step S1301), a recording operation is performed (step S1310), and the steps S1310–S1311 are repeated until a single set of papers P have been completed. Then, the program returns to the step S1309. The amount of fine adjustment of the stop 60 may preferably be adjustable at the outside of the finisher (e.g. on the operation board 128).

Figure 10:
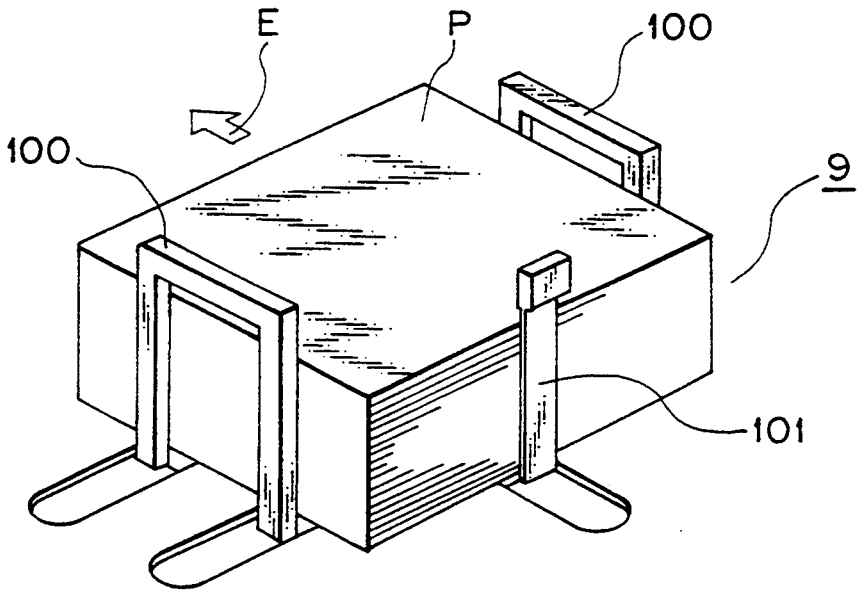
FIG. 10 is a perspective view of a paper setting section included in the second embodiment.
Figure 11:
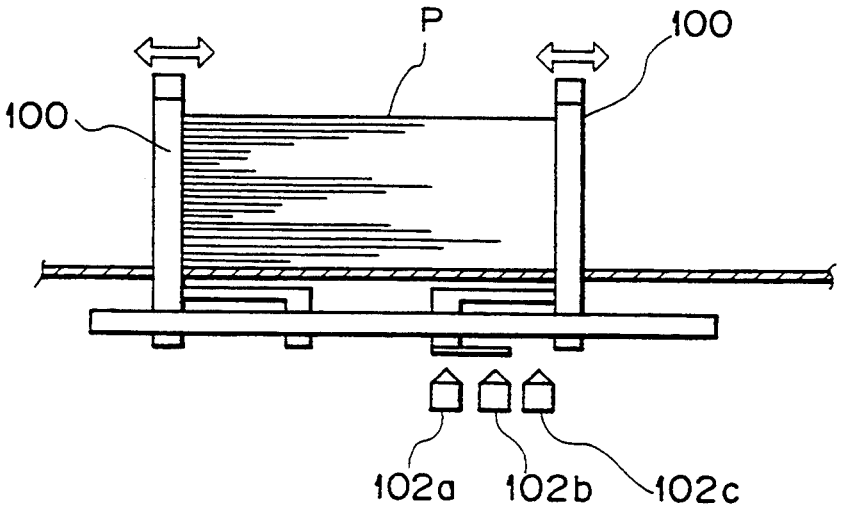
FIG. 11 is a side elevation associated with FIG. 10.

Even when the papers P are of the same kind and number, the elastic deformation as measured in the direction of transport depends on their size, as stated earlier. Preferably, therefore, the amount of fine adjustment should be changed on the basis of the paper size. As shown in FIGS. 10 and 11, the paper size may be measured at fences 100 and 101 included in a paper setting section 9. Alternatively, the paper size may be determined in terms of the document size and magnification. Further, a signal representative of a paper size may be sent from a file memory. In FIGS. 10 and 11, sensors **102*a*, 102*b* and 102*c* are provided to sense the positions of the fences 100 and 101**.

Figure 14:
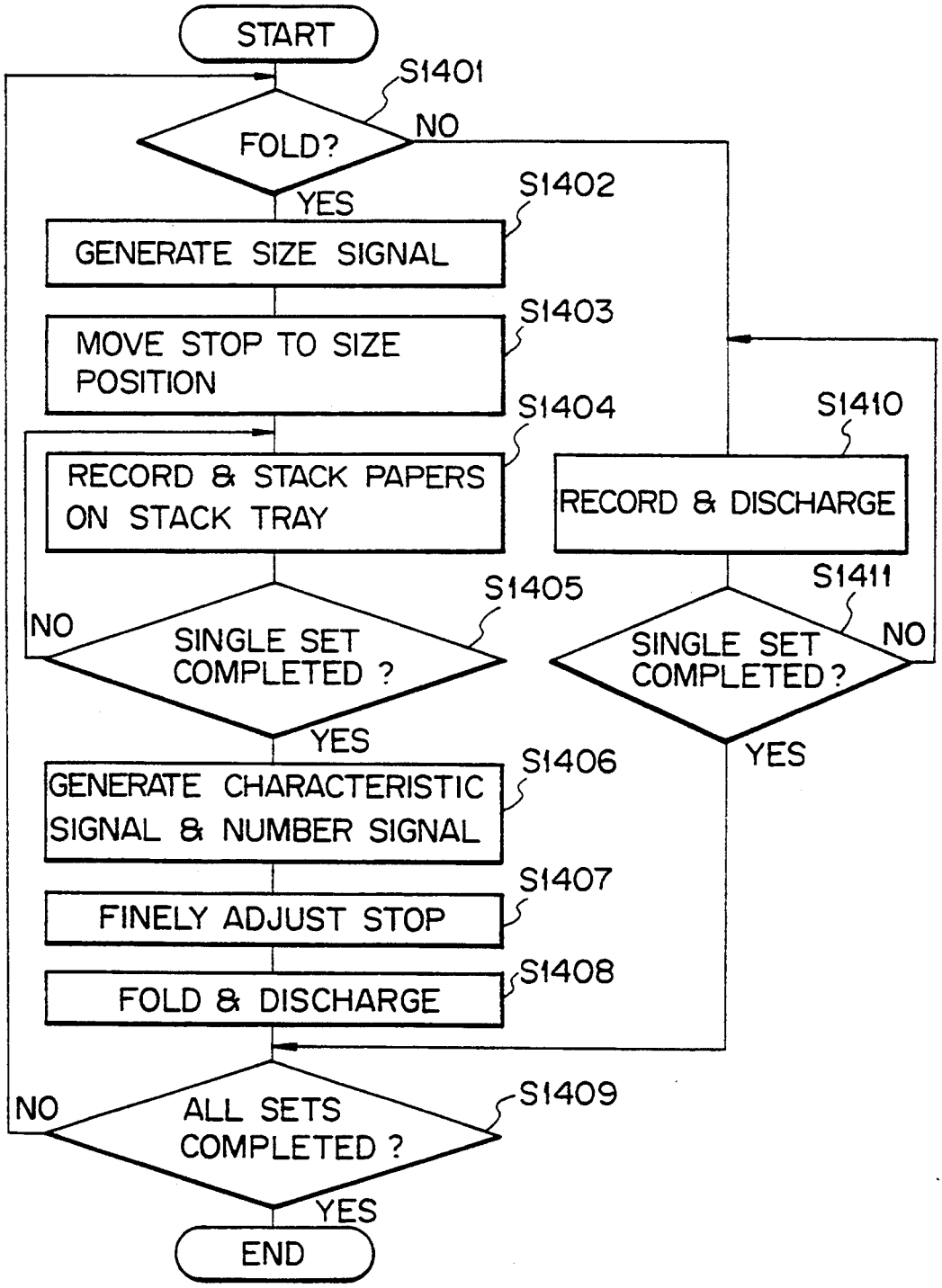

FIG. 14 shows an alternative procedure which folds a plurality of papers P at the same time. As shown, when the papers P should be folded (YES, step S1401), the stop 60 is shifted to a position matching the paper size by a paper size signal (steps S1402 and S1403). Before or after this movement, a recording operation is executed, and the papers P are sequentially stacked on the staple tray 50 (S1404). When at least a single set of papers P are stacked, the position of the stop 60 is finely adjusted in response to a paper characteristic signal and a paper number signal (steps S1406 and S1407), and then the papers P are folded and discharged (step S1408). The steps S1401–S1409 are repeated until all the desired number of sets have been dealt with. On the other hand, when the papers P should not be folded (NO, step S1401), the steps S1410–1411 are repeated until a single set of papers P have been completed. Then, the program advances to the step S1409. In this manner, a paper characteristic signal and a paper number signal are received when at least a single set of papers P are completed, and they are also used for the fine adjustment of the stop 60.

Figure 15A:
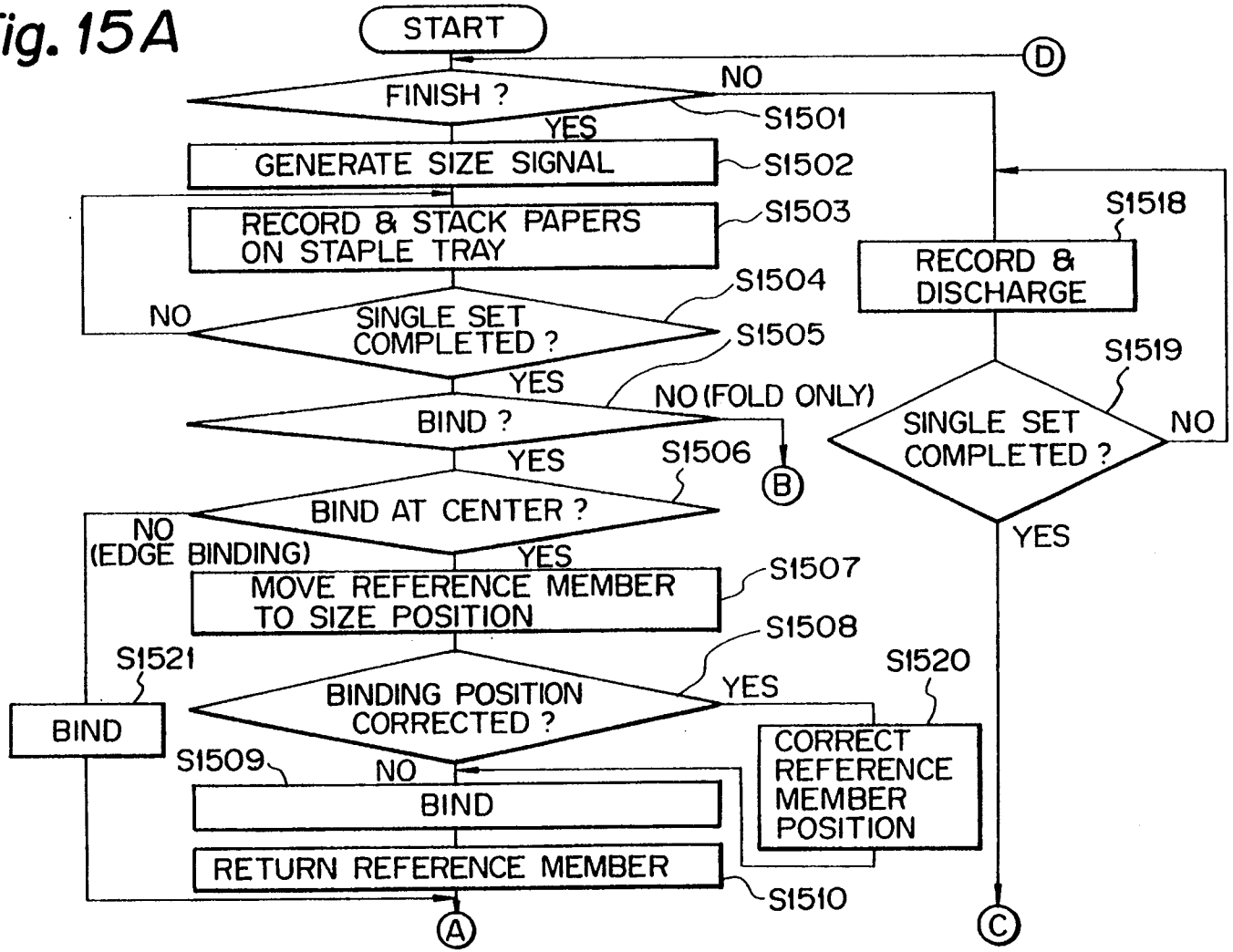
Figure 15B:
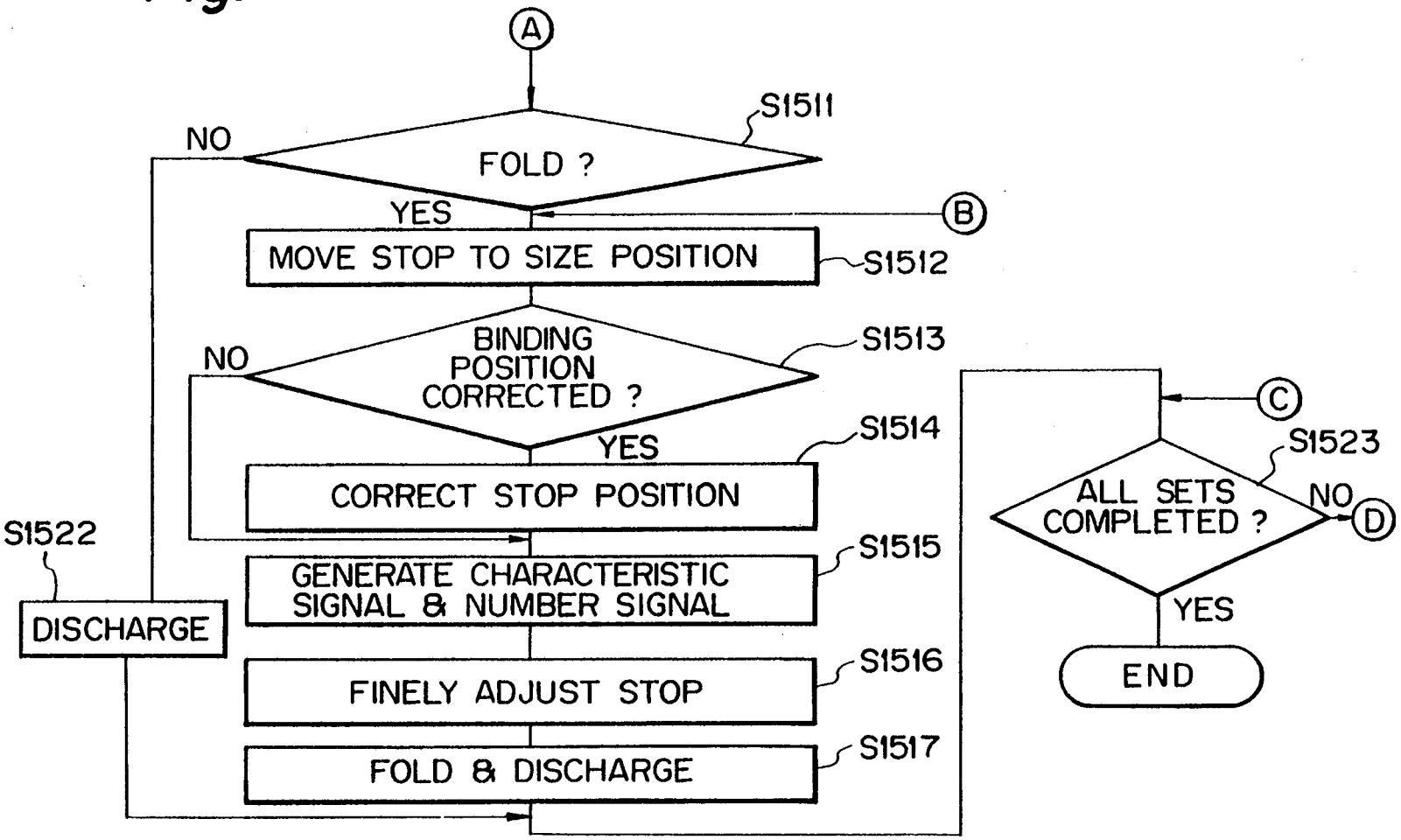

FIGS. 15A and 15B demonstrate a procedure for binding the papers P at the center and then folding them at the center. As shown, when the papers P should be finished (YES, step S1501), a paper size signal is generated (step S1502). Then, a recording operation is performed, and the papers P are sequentially stacked on the staple tray 50 (step S1503). When at least a single set of papers P are completed (YES, step S1504) and if the papers P should be bound at the center (YES, step S1505 and YES, step S506), the reference member 52 is shifted to a size matching the paper size (step S1507). If the binding position needs correction, it is corrected (steps S1508 and S1520). Then, the papers P are bound (step S1509). Subsequently, the step 60 is shifted to a position matching the paper size (step S1512). If the binding position has been corrected, the position of the stop 60 is also adjusted (steps S1513 and S1514). In response to a paper characteristic signal and a paper number signal, the position of the stop 60 is finely adjusted (steps S1515 and S1516). In this condition, the papers P are folded and then discharged (step S1517). The steps S1501–S1523 are repeated until all the desired number of sets have been completed.

When the papers P should not be bound as determined in the step S1505, the program advances to a step S1512 for folding the papers P. If the papers P are expected to be bound at the edge (NO, step S1506), they are bound at the edge (step S1521). This is followed by a step S1511. If the papers P should not be folded (NO, step S1511), the papers P are discharged (step S1522), and then a step S1523 is executed. On the other hand, when the papers P should not be finished (NO, step S1501), the papers P undergone recording are discharged (step S1518). The steps S1518–S1519 are repeated until a single set of papers P have been completed. This is followed by the step S1523.

As stated above, in the center bind mode, the papers P are fully stacked on the staple tray 50, the reference stacking position is shifted, and then the papers P are bound.

When the binding position is corrected to the user's taste or for higher accuracy, it is deviated relative to the folding position. Then, the position of the stop 60 is corrected in an amount matching the deviation at the time of folding.

While the embodiment binds the papers P first and then folds them, it may fold them before binding them. It is preferable that the reference member 52 and the stop 60 be adjustable in position independently of each other so as to insure accurate basic values at the time of, for example, production.

The folding accuracy is effected by the characteristics and number of the papers although the stacking accuracy is free from their influence. The correction of the stop 60 also becomes inaccurate if maintained in a fixed relation with the correction of the reference member 52. In the illustrative embodiment, the amounts of correction are changed on the basis of the characteristics and number of the papers P to match the binding position and folding position with higher accuracy. After the papers P have been folded, their edges opposite to the bound portion may be cut, if desired.

The second embodiment described above also has various advantages, as follows. Since the position of the stop 60 is controlled in response to a paper characteristic signal, the papers P can be folded with accuracy. The position of the stop 60 is controlled in response to a paper number signal as well, the papers P, whether the number thereof be one or more, can be folded with accuracy.

Since the stop 60 is movable to any one of a plurality of positions matching the paper size, the papers P can be accurately folded with no regard to their size. The amount in which the stop 60 is to be finely adjusted depending on the kind and number of the papers P differs from one paper size to another, further enhancing accurate folding.

In the center bind mode, when either of the folding position and binding position is corrected, the other position is corrected accordingly. This allows the folding position and binding position to match with accuracy in the center bind mode. In addition, since the relation between the amounts of correction of the binding position and folding position is changed in matching relation to the characteristics and number of the papers P, the folding position and binding position accurately match in the center bind and fold mode with no regard to the number or the kind of the papers P.

Referring to FIGS. 16–19B, a third embodiment of the present invention will be described. In this embodiment, the recording apparatus causes the stapler 53 to drive the staple 70 into the stack of papers P at the upper end of the stack, i.e., at the side of the paper P printed last. Therefore, to effect the edge bind mode, it is necessary that the paper P carrying the first page be stacked last and face up, so that the flat side of the staple 70 may be positioned on the first page. Specifically, in a one-sided record mode, the last page to the first page are sequentially recorded on papers, and the papers are stacked on the staple tray 50 face up in the same order. In a two-sided record mode, the last page or the second page from the last to the first page are recorded in this order, and the papers P are stacked on the staple tray 50 with their pages of low numbers facing upward. Further, to bind the papers P at the center, it is necessary to stack the paper P carrying the first page and last page last and face up.

To meet the above requirements, the illustrative embodiment determines the number of papers N on the basis of a signal representative of the number of pages to be recorded. If the number of pages is not the multiple of "4", a blank page is added to make the total number of pages 1 to 4N. The "2N" page and "2N+1" page (corresponding to the intermediate spread pages of a booklet) are recorded on one side of a paper P. Then, the "2N−1" page and "2N+2" page are recorded on the other side of the paper P. This paper P is stacked on the staple tray 50 such that the side carrying the "2N" page and "2N+1" page faces downward. It is to be noted that which of the front and rear of the paper P is recorded first is not an issue so long as the paper P is stacked in the above-mentioned orientation. This can be selected depending on the conditions of the apparatus, e.g., the orientation of the paper P coming out of the recording section and the presence/absence of a turning device. The above procedure is sequentially executed with all of the pages. After the paper P carrying the first, second, "4N−1" and "4N" pages has been stacked on the staple tray 50 with the second and "4N−1" pages facing upward, the paper stack is bound at the center, folded at the center, and then discharged. The operation ends when the procedure is repeated with the desired number of sets of papers.

Figure 16:
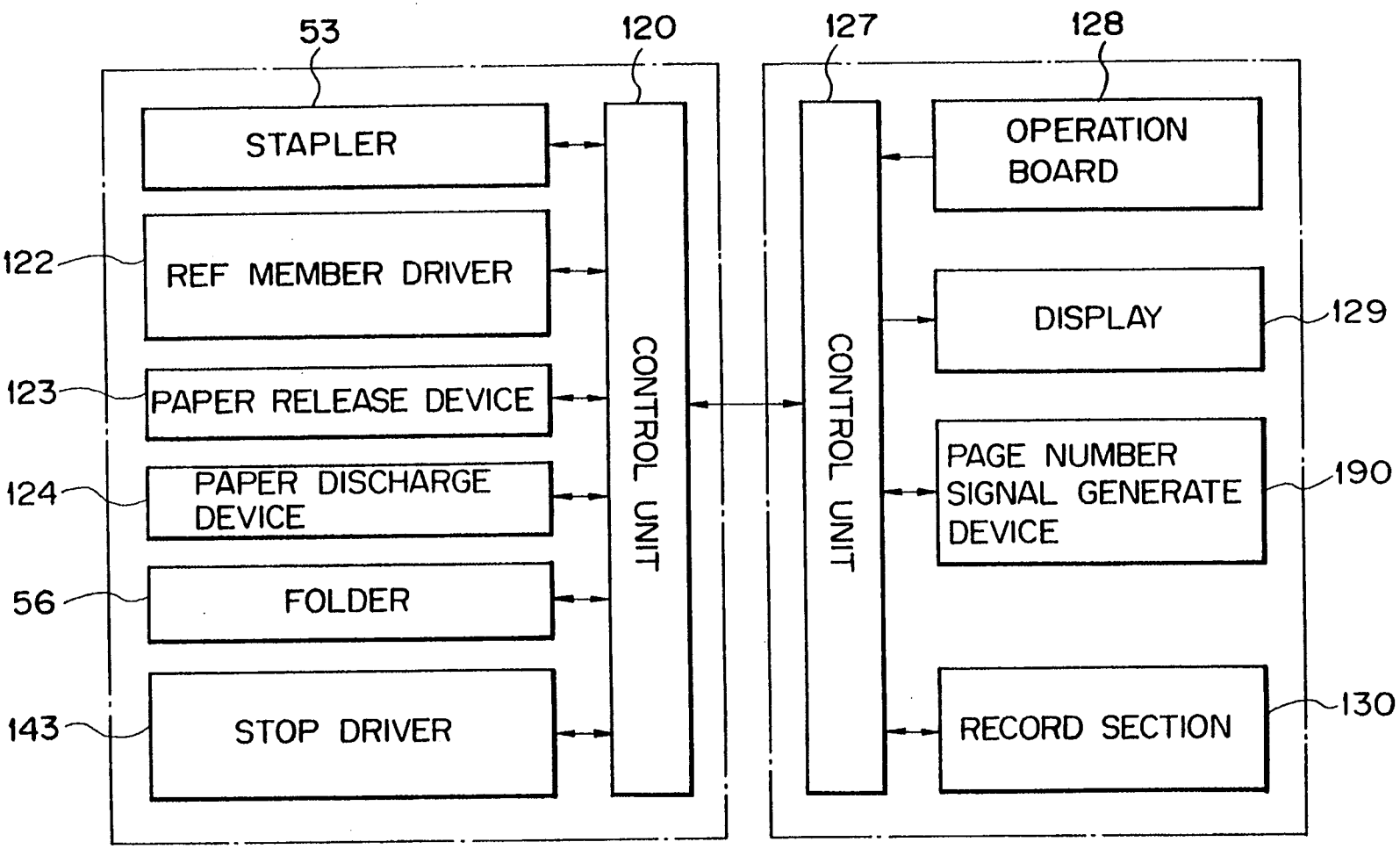
FIG. 16 is a block diagram schematically showing control circuitry representative of a third embodiment of the present invention.
Figure 17A:
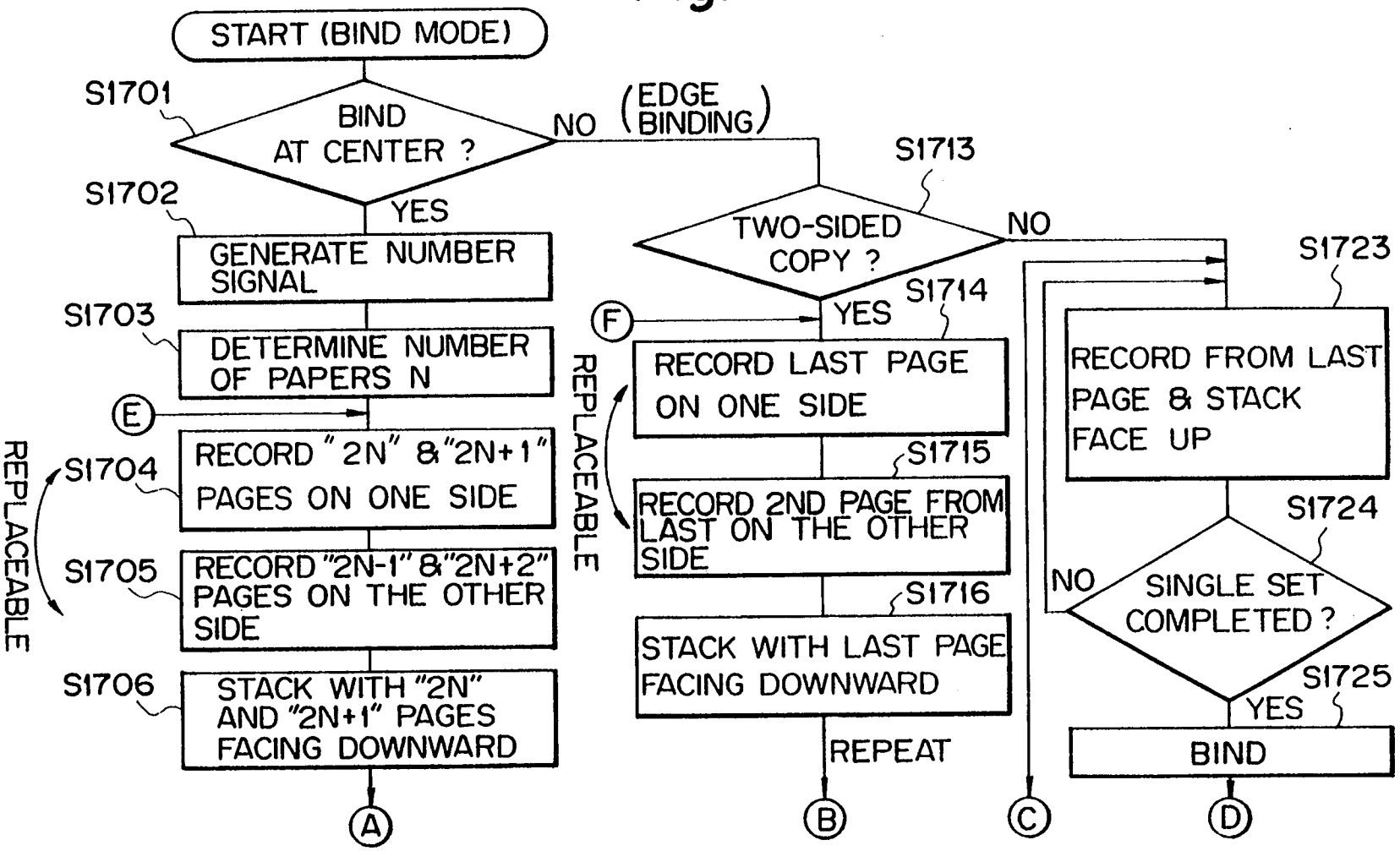
FIGS. 17A and 17B are flowcharts demonstrating a specific operation of the control circuitry shown in FIG. 16.

FIG. 16 shows control circuitry particular to the embodiment while FIGS. 17A and 18B demonstrate a sequence of steps to be executed by the circuitry. As shown in FIG. 16, the control circuitry has the control unit 12D included in the binder, the stapler 53, the reference member driver 122, the paper releasing device 123, the paper discharging device 124, the folder 56, the stop driver 143, the control unit 127 included in the recording apparatus, the operation board 128, the display 129, a page number signal generating unit 190, and the recording section 130. The control unit 120 controls the stapler 53, reference member driver 122, paper releasing device 123, paper discharging device 124, folder 56, and stop driver 143. The control unit 127 controls the operation board 128, display 129, page number signal generating unit 190, and recording unit 130. The control units 120 and 127 are connected to each other.

Figure 17B:
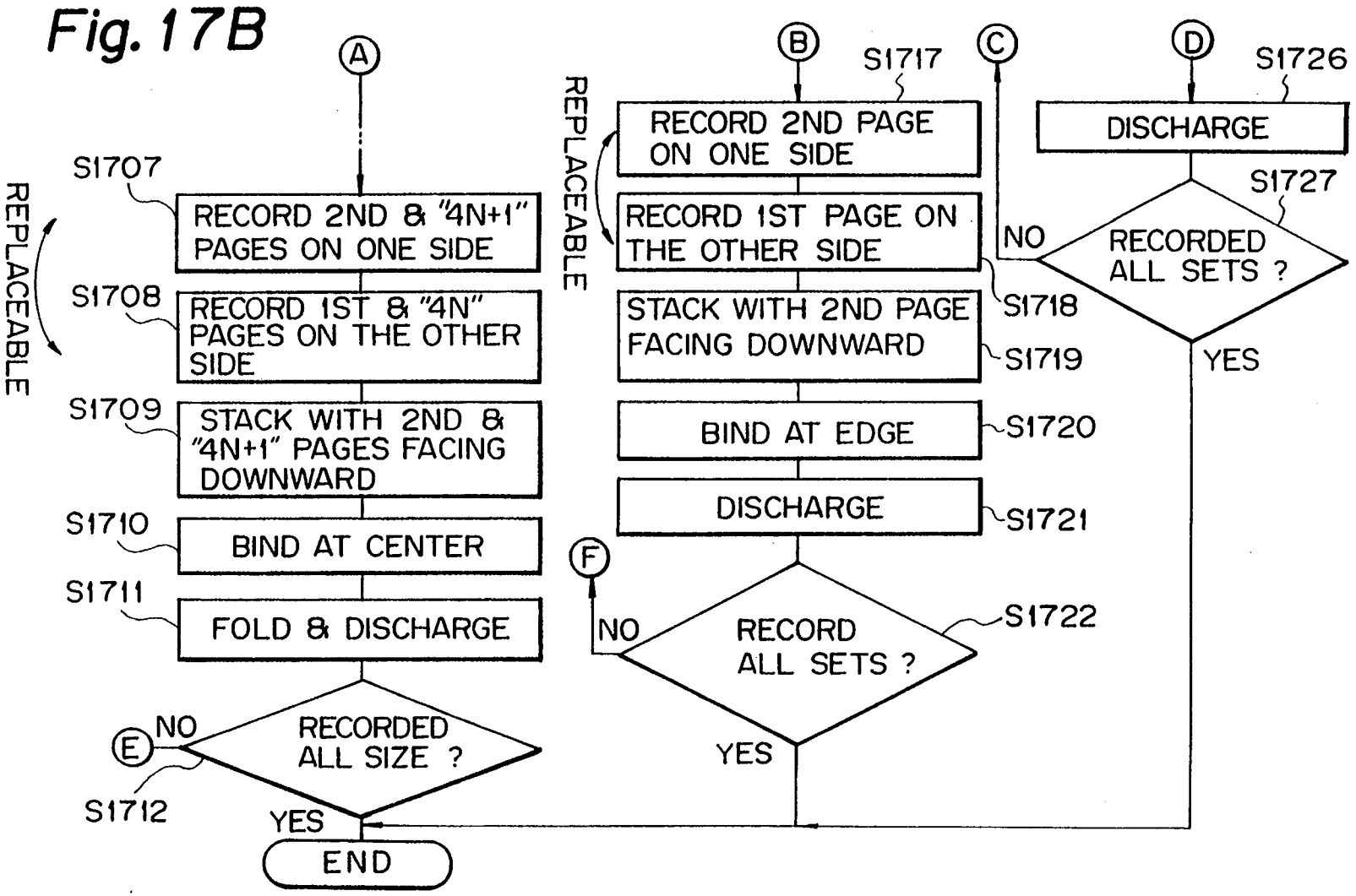

The operation of the control circuitry will be described with reference to FIGS. 17A and 17B. In the bind mode, when the papers P should be bound at the center (YES, step S1701), a page number signal is generated (step S1702), and the number of papers N is determined (step S1703). The 2N and "2N+1" pages are recorded on one side of a paper P (step S1704), and then the "2N−1" and "2N+2" pages are recorded on the other side of the paper P (step S1705). This paper P is stacked on the staple tray 50 with the 2N and "2N+1" pages facing downward (step S1706). This operation is repeated to record the second and "4N−1" pages on one side of a paper P (step S1707) and record the first and ""4N" pages on the rear of the same paper P (step S1708). This paper P is stacked with the second and "4N−1" pages facing downward (step S1709). Subsequently, the stacked papers P are bound at the center (step S1710), and then folded and discharged (step S1711). Such a procedure is repeated until all the desired number of sets of papers have been dealt with (NO, step S1712). Then, the program ends (YES, step S1712).

When the papers P should be bound at the edge and in the two-sided record mode (NO, step S1701 and YES, step S1713), the last page is recorded on the rear of a paper P (step S1714), the second page from the last is recorded on the rear of the paper (S1715), and then the paper P is stacked on the staple tray 50 with the last page facing downward (step S1716). This is repeated to record the second page on one side of a paper P (step S1717), record the first page on the rear of the same paper P (step S1718), and then stack the paper P on the staple tray 50 with the second page facing downward (step S1719). Subsequently, the papers P are bound at the edge (step S1720) and then discharged (step S1721). The above procedure is repeated until all the desired number of sets of papers P have been dealt with (NO, step S1722). Then, the program ends (YES, step S1722).

When the papers P should be bound at the edge and in a mode other than the two-sided record mode (NO, step S1701 and NO, step S1713), the last page to the first page are recorded on papers P in this order, and the papers are sequentially stacked on the staple tray 50 (step S1723). When a single set of papers P are completed (YES, step S1724), the papers P are bound at the edge (steps S1725 and S1726). This procedure is repeated until all the desired number of sets of papers P have been completed (NO, step S1727). Then, the program ends (YES, step S1727).

In the two-sided record mode, the embodiment sequentially records images on the front and rear of a single paper P at time, as stated above. Alternatively, any other suitable recording sequence may be used to enhance the efficiency. For example, images may be recorded on one side of all of N papers P and then on the other side of the N papers. Further, when images are to be formed on both sides of M sets of paper sheets, papers may be alternately fed from an intermediate tray and a paper tray for the second set to the "M-1" set, as disclosed in Japanese Patent Laid-Open Publication Nos. 16976/1986 and 26860/1982 by way of example. In any case, in the center bind mode, recording begins with the "2N+1" page or with the "2N−1" and "2N+2" pages while, in the edge bind mode, it begins with the last page or the second page from the last.

Figure 18:
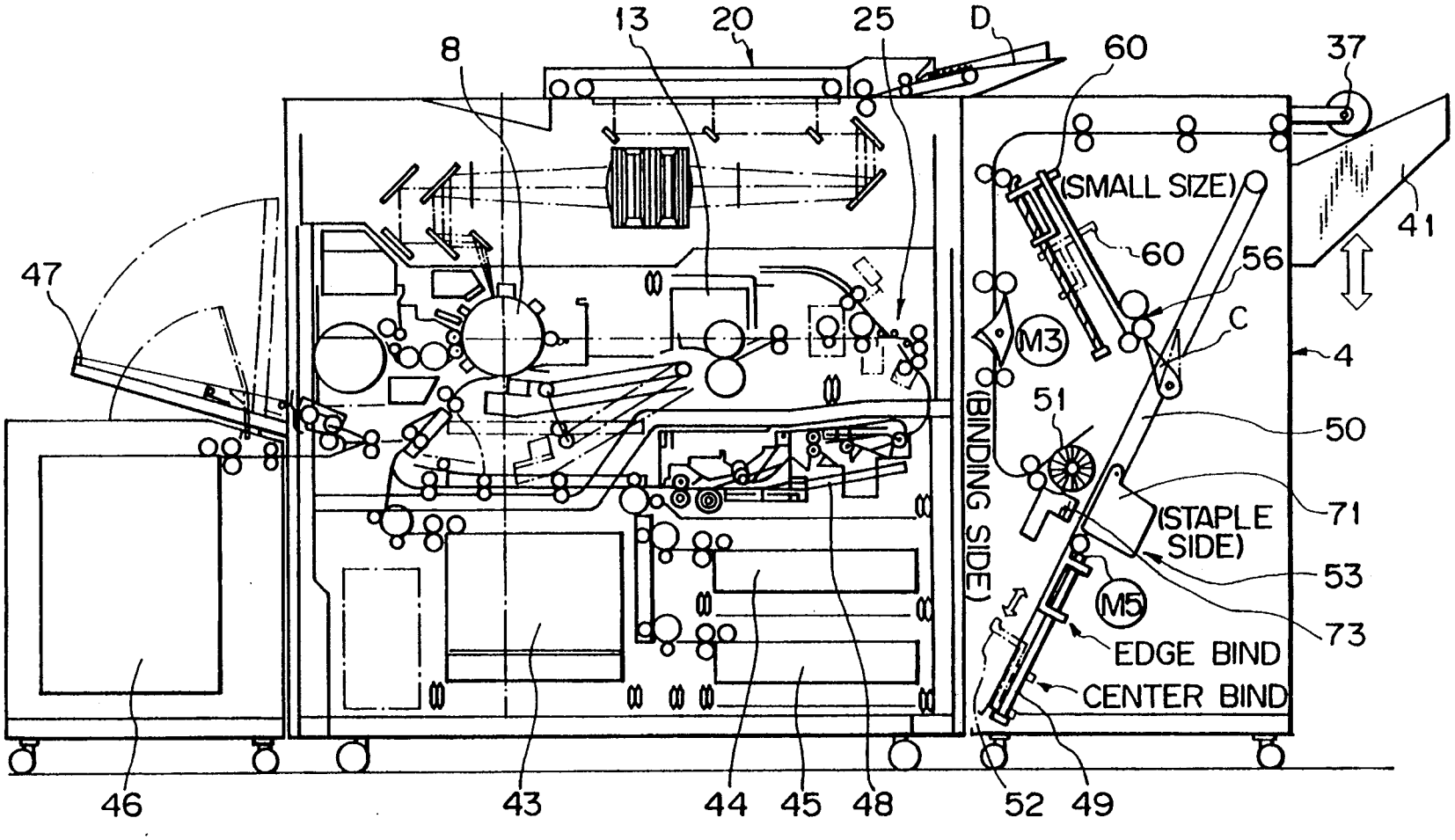
FIG. 18 is a section showing the mechanical arrangement of the third embodiment.
Figure 19A:
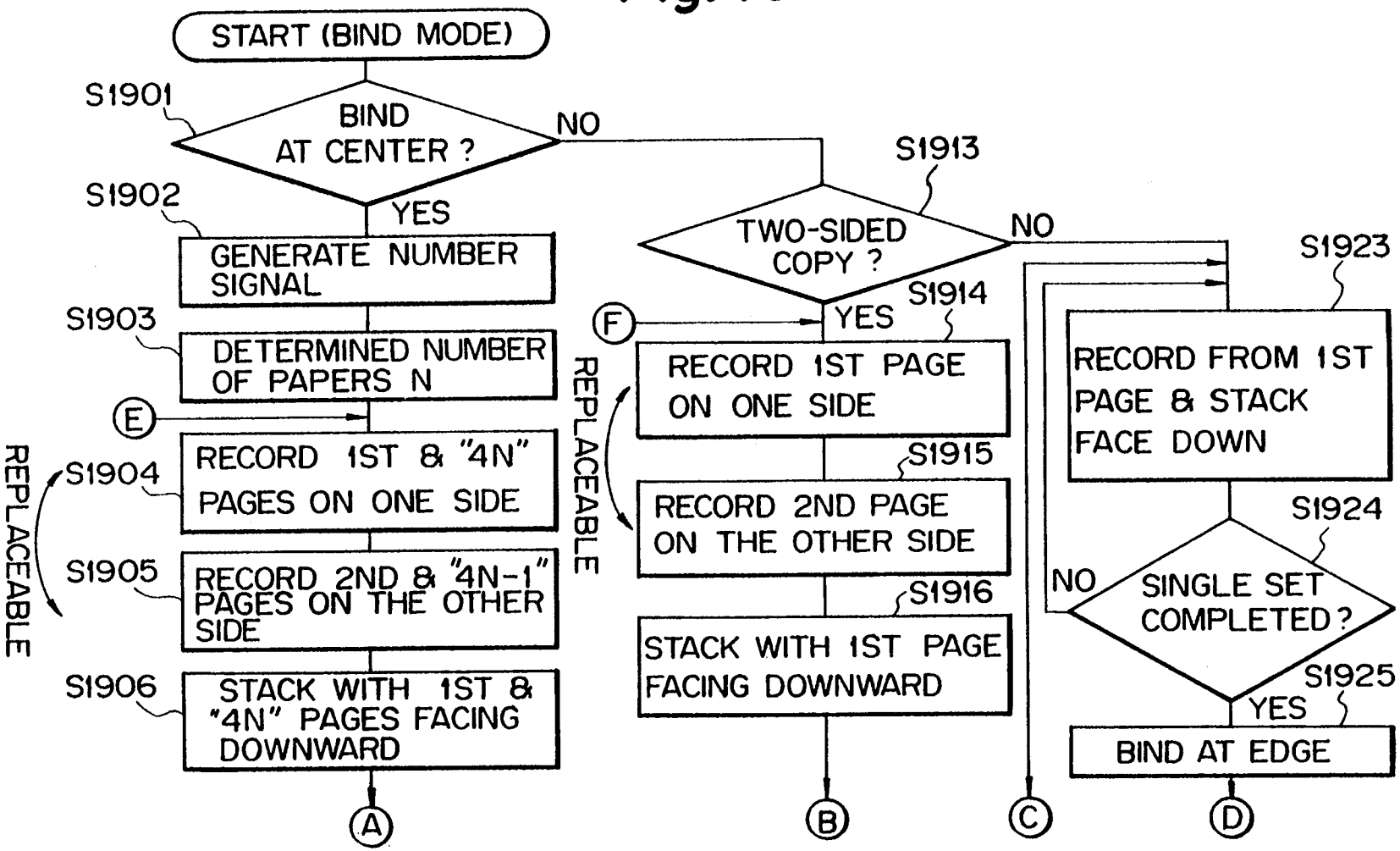
FIGS. 19A and 19B are flowcharts showing another specific operation of the third embodiment.
Figure 19B:
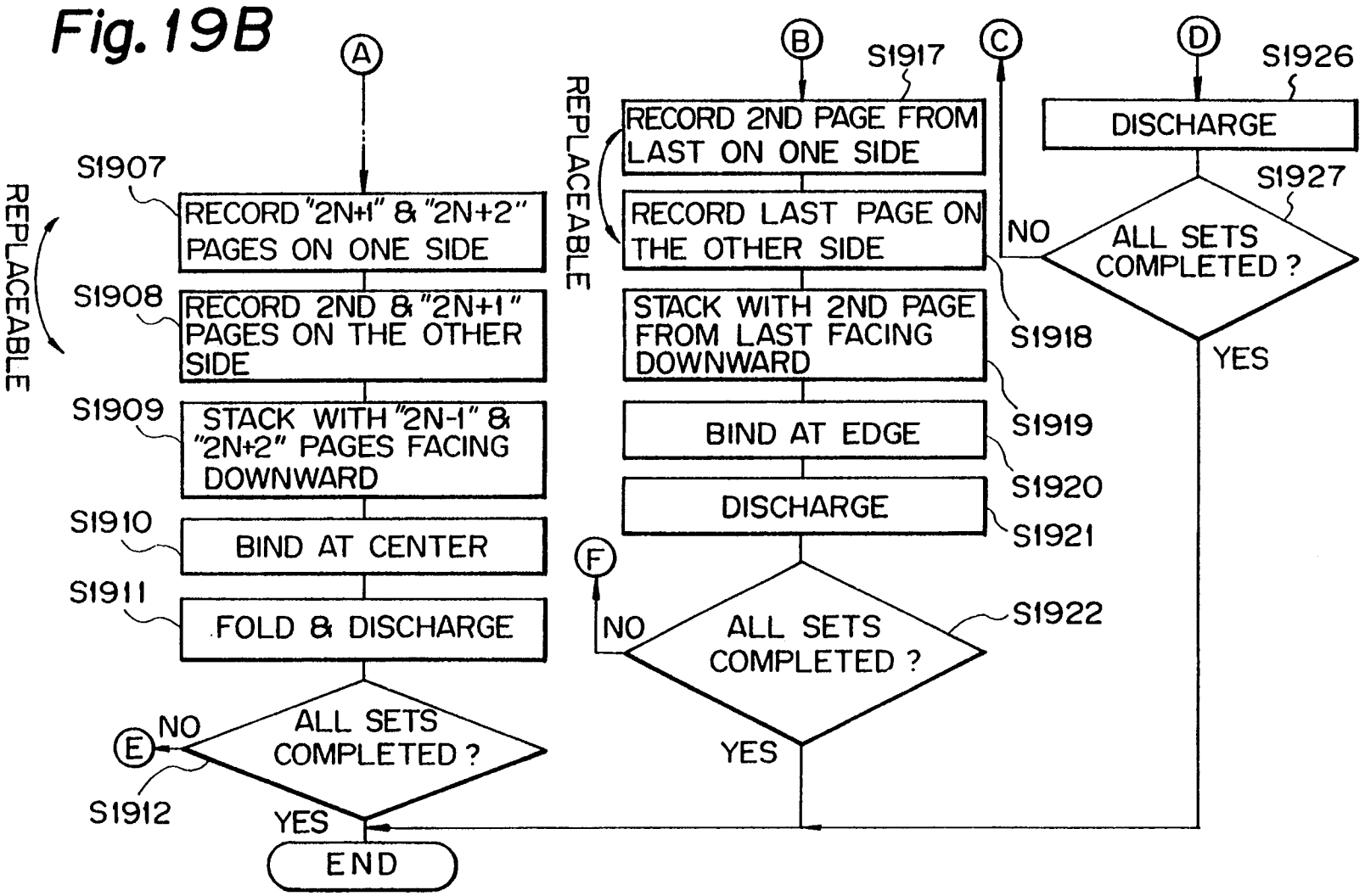

FIG. 18 shows a recording apparatus implemented with a stapler of the type driving a staple from below a stack of papers. As shown, the apparatus has a turning section 25, a first paper tray 43, a second paper tray 44, a third paper tray 45, a mass paper feed tray 46, a tray 47 for manual paper insertion, an intermediate tray 48, a threaded shaft 49 for moving a reference member 52, and a motor M5 for driving the shaft 49. In the apparatus of FIG. 18, the same constituent parts as those of the above embodiment are designated by the same reference numerals, and a detailed description will not be made to avoid redundancy.

In FIG. 18, documents D are stacked face down and sequentially fed, the first page being first. The papers P are sequentially transferred from the recording apparatus to the binder 4, the lowest page being first. In the one-sided copy mode and edge bind mode, the first page to the last page are sequentially recorded on papers P. The papers P are each turned over by the turning section 25 of the apparatus body and then stacked on the staple tray 50 face down. When all the papers P are stacked on the staple tray 50, they are bound at the edge from below by the stapler 53 and then driven out to the tray 41. In the two-sided copy mode and edge bind mode, the first page is recorded on one side of a paper P, and then the second page is recorded on the other side of the same paper P. This paper is stacked on the staple tray 50 with the first page facing downward.

Assume a copier, printer or similar recording apparatus of the type using an ADF having a document turning capability or a recycling document handler of the type dealing with pages digitally. Then, for example, the second page, first page, fourth page, third page and so forth may be recorded in this order. In this case, the paper P carrying images on both sides thereof is turned over by the turning device 25 and then stacked on the staple tray 50 with the page of low number facing downward. After all of the papers P have been stacked on the staple tray 50, they are bound by the stapler 53.

In the center bind mode, the first to "4N" pages are set. Then, the first and "4N" pages or the second and "4N−1" pages are recorded on one side of a paper P, and then the non-recorded pages associated therewith are recorded on the other side of the same paper P. This paper is stacked on the staple tray 50 with the first and "4N" pages facing downward.

The above procedure is repeated with all the pages. Each paper is stacked on the staple tray 50 such that the side thereof carrying the page of lowest number and the page of highest number faces downward. Thereafter, the reference member 52 is shifted to the center binding position together with the papers P. The stapler 53 binds the papers P at the same position as in the edge bind mode. Subsequently, the bound papers P are moved upwardly. As the path selector or pawl C guides the papers P to the folding section, the stop 60 and three coactive fold rollers 58 fold the papers P in two such that the side of the papers P where a staple 70 has been driven is convex. The folded paper sheets P are transported upwardly rightward with the folded portion at the head. At this instant, a part of the staple tray 50 implements a discharge path to realize a compact and inexpensive arrangement.

Two-sided copies may be produced by any other suitable method, as stated earlier.

A procedure for controlling the binding operation as described above is shown in FIGS. 19A and 19B. As shown, in the center bind mode (YES, step S1901), a page number signal is generated (step S1902), and the number of papers N is determined (step S1903). Then, the first and fourth pages are recorded on one side of a paper P (step S1904), and the second and "4N−1" pages are recorded on the other side of the paper P (step S1905). This paper P is stacked on the staple tray 50 with the first and fourth pages facing downward (step S1906). This is repeated to record the "2N−1" and "2N+2" pages on one side of a paper P (step S1907) and the 2N and "2N+1" pages on the other side of the same paper P (step S1908); the paper is stacked with the "2N−1" and "2N+2" pages facing downward (step S1909). Subsequently, these papers are bound at the center (step S1910), and then folded and discharged (step S1911). Such a procedure is repeated until all the desired number of sets of papers P have been dealt with (NO, step S1912). Then, the program ends (YES, step S1912).

In the edge bind mode and two-sided copy mode (NO, step S1901 and YES, step S1913), the first page is recorded on one side of a paper P (step S1914), and the second page is recorded on the other side of the paper P (step S1915). This paper P is stacked on the staple tray 50 with the first page facing downward (step S1916). This is repeated until the second page from the last has been recorded on one side of a paper P (step S1917) and the last page has been recorded on the other side of the paper P (step S1918). This paper P is stacked on the staple tray 50 with the second page from the last facing downward (step S1920). Such papers P are bound at the edge (step S1920) and then discharged (step S1921). The above procedure is repeated until all the desired number of sets of papers P have been completed (NO, step S1922). Then, the program ends (YES, step S1922).

In the edge bind mode and a mode other than the two-sided copy mode (NO, step S1901 and NO, step S1913), the first page to the last page are sequentially recorded on papers P, and the papers P are sequentially stacked on the staple tray 50 face up (step S1923). When a single set of papers P is completed (YES, step S1924), they are bound and then discharged (steps S1925 and S1926). Such a procedure is repeated until all the desired number of sets of papers P have been dealth with (NO, step S1927). Then, the program ends (YES, step S1927).

The third embodiment described above also has various advantages, as follows. The embodiment sets up a particular order of pages and a particular stacking orientation in each of the edge and center bind modes. This allows the two different modes to share the stapler 53 of the type driving the staple 70 from above the stack and the staple tray 50, thereby reducing cost and saving space. Further, the embodiment sets up a particular folding direction for the center bind mode. This prevents the ends of the staple 70 from protruding from the bound and folded stack, thereby avoiding danger and making the stack attractive.

Moreover, the embodiment sets up a particular order of pages and a particular orientation of a paper (in the up-and-down direction) in each of the edge bind mode and center bind mode. This allows the two different modes to share the stapler 53 of the type driving the staple 70 from below a paper stack and the staple tray 50, also reducing cost and saving space.

The embodiments shown and described are applicable not only to a digital copier but also to an analog copier and even to a facsimile apparatus and printer.

Various modifications will become possible for those skilled in the art after receiving the teachings of the present disclosure without departing from the scope thereof.

What is claimed is:

1. In a recording apparatus, a first record mode for recording an image on one or both sides of a sheet, a second record mode for recording two pages of images on one side of a sheet and other two pages of images on the other side of said sheet, a first bind mode for stacking the sheets undergone said first record mode on a staple tray and then binding said sheets by a stapler of a type driving a staple into an edge of a stack of said sheets from above said stack, and a second bind mode for stacking the sheets undergone said second record mode and then binding said sheets at a center of said sheets are provided;

in said first record mode, recording beginning with, among all pages, the last page or the second page from the last, the papers carrying said all pages being sequentially stacked on said staple tray such that the last page is lowest;

in said second record mode and if a blank page exists, assuming that N papers are required to record the total number of pages including said blank page, recording beginning with a "2N" page and a "2N+1" page or with a "2N−1" page and a "2N+2" page, the sheets being sequentially stacked on said staple tray such that the "2N" page and the "2N+1" page are lowest and then bound in either of said first bind mode and said second bind mode.

2. In a recording apparatus, a first record mode for recording an image on one or both sides of a sheet, a second record mode for recording two pages of images on one side of a sheet and other two pages of images on the other side of said sheet, a first bind mode for stacking the sheets undergone said first record mode on a staple tray and then binding said sheets by a stapler of a type driving a staple into an edge of a stack of said sheets from above said stack, and a second bind mode for stacking the sheets undergone said second record mode and then binding said sheets at a center of said sheets are provided;

in said first record mode, recording beginning with, among a total number of pages to record, the first page or the second page, sheets carrying said total number of pages being sequentially stacked on said staple tray such that the first page is lowest;

in said second record mode and if a black page exists, assuming N sheets are required to record a total number of pages including said blank page, recording beginning with the first page and the "4N" page or with the second page and the "4N−1" page, sheets carrying said total number of pages being sequentially stacked on said staple tray such that the first page and the "4N" page are lowest and then bound in either of said first bind mode and said second bind mode.

* * * * *